US010209658B2

(12) United States Patent
Toyofuku et al.

(10) Patent No.: US 10,209,658 B2
(45) Date of Patent: Feb. 19, 2019

(54) IMAGE FORMING SYSTEM, IMAGE FORMING APPARATUS, TONE CORRECTION METHOD, NON-TRANSITORY RECORDING MEDIUM STORING COMPUTER READABLE TONE CORRECTION PROGRAM, AND IMAGE DENSITY CORRECTION METHOD

(71) Applicant: Konica Minolta, Inc., Chiyoda-ku, Tokyo (JP)

(72) Inventors: Katsuya Toyofuku, Tokyo (JP); Daiki Yamanaka, Kanagawa (JP); Toru Yamaguchi, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/678,696

(22) Filed: Aug. 16, 2017

(65) Prior Publication Data

US 2018/0052413 A1 Feb. 22, 2018

(30) Foreign Application Priority Data

Aug. 17, 2016 (JP) ..... 2016-159908
Sep. 2, 2016 (JP) ..... 2016-171698

(51) Int. Cl.
*G03G 15/00* (2006.01)
*G03G 15/01* (2006.01)

(52) U.S. Cl.
CPC ..... *G03G 15/5029* (2013.01); *G03G 15/0121* (2013.01); *G03G 15/0189* (2013.01); *G03G 15/5041* (2013.01); *G03G 15/5058* (2013.01); *G03G 15/5062* (2013.01)

(58) Field of Classification Search
CPC ..... G03G 15/5025; G03G 15/5041; G03G 15/5054; G03G 15/5058; G03G 15/5062
USPC ..... 399/15, 49, 72
See application file for complete search history.

(56) References Cited

U.S. PATENT DOCUMENTS 8,553,287 B2 * 10/2013 Yasutomi et al. ... H04N 1/4058 358/3.06

FOREIGN PATENT DOCUMENTS

JP 2008224845 A 9/2008

* cited by examiner

*Primary Examiner* — William J Royer
(74) *Attorney, Agent, or Firm* — Cantor Colburn LLP

(57) ABSTRACT

An image forming system includes: a density detecting section that detects the density of a toner image formed on an image bearing member by an image forming section, the density being detected as an output image density; a hardware processor which performs; tone correction in accordance with input-output characteristics data indicating the relationship between an input image density and an output image density, the input image density being the image density of a tone component included in the input image data, the output image density being detected by the density detecting section in accordance with the tone component; determining whether there is a missing tone component in the input image data; and complementing the input-output characteristics data corresponding to a missing tone component, when it is determined that there is the missing tone component.

35 Claims, 16 Drawing Sheets

| TONE | R (RED) | G (GREEN) | B (BLUE) | G (GRAYSCALE) |
|---|---|---|---|---|
| 10% | R10%(Y10%,M10%) | G10%(Y10%,C10%) | B10%(C10%,M10%) | Gray10%(Y10%,M10%,C10%) |
| 20% | R20%(Y20%,M20%) | G20%(Y20%,C20%) | B20%(C20%,M20%) | Gray20%(Y20%,M20%,C20%) |
| ⋮ | ⋮ | ⋮ | ⋮ | ⋮ |
| 80% | R80%(Y80%,M80%) | G80%(Y80%,C80%) | B80%(C80%,M80%) | Gray80%(Y80%,M80%,C80%) |
| ⋮ | ⋮ | ⋮ | ⋮ | ⋮ |
| 100% | R100%(Y100%,M100%) | G100%(Y100%,C100%) | B100%(C100%,M100%) | Gray100%(Y100%,M100%,C100%) |

FIG. 14

| | | Y | | | M | | | C | | | K | | | DENSITY INFORMATION | RELIABILITY |
|---|---|---|---|---|---|---|---|---|---|---|---|---|---|---|---|
| | | HIGHLIGHT | HALFTONE | SOLID | HIGHLIGHT | HALFTONE | SOLID | HIGHLIGHT | HALFTONE | SOLID | HIGHLIGHT | HALFTONE | SOLID | | |
| Y | HIGHLIGHT | | | | A | | | | A | | | | | B | |
| | HALFTONE | | A | | A | A | | | | A | | | | A | 10 |
| | SOLID | | | | | | A | A | | | | | | B | |
| M | HIGHLIGHT | A | A | | A | | | | | | | | | A | 10 |
| | HALFTONE | | A | | | | | | A | | | | | B | |
| | SOLID | | | A | | | A | | A | | | | | A | 10 |
| C | HIGHLIGHT | A | | | | | | | | | | | | B | |
| | HALFTONE | A | | | | A | A | | A | | | | | A | 10 |
| | SOLID | | A | | | | | | | | A | | | B | |
| K | HIGHLIGHT | | | | | | | | | A | | | | B | |
| | HALFTONE | | | | | | | | | | | A | | A | 10 |
| | SOLID | | | | | | | | | | | | A | A | 10 |

FIG. 15

| | | Y | | | M | | | C | | | K | | | DENSITY INFORMATION | RELIABILITY |
|---|---|---|---|---|---|---|---|---|---|---|---|---|---|---|---|
| | | HIGHLIGHT | HALFTONE | SOLID | HIGHLIGHT | HALFTONE | SOLID | HIGHLIGHT | HALFTONE | SOLID | HIGHLIGHT | HALFTONE | SOLID | | |
| | | | 10 | | 10 | | 10 | | 10 | | | 10 | 10 | | |
| Y | HIGHLIGHT | | | | A | | | | A | | | | | B | 9 |
| | HALFTONE | | A | | A | A | | | | A | | | | A | 10 |
| | SOLID | | | | | | A | A | | | | | | B | 8 |
| M | HIGHLIGHT | A | A | | A | | | | | | | | | A | 10 |
| | HALFTONE | | A | | | | | | A | | | | | B | 9 |
| | SOLID | | | A | | | A | | A | | | | | A | 10 |
| C | HIGHLIGHT | A | | | | | | | | | | | | B | |
| | HALFTONE | A | | | | A | A | | A | | | | | A | 10 |
| | SOLID | | A | | | | | | | | A | | | B | 8 |
| K | HIGHLIGHT | | | | | | | | | A | | | | B | |
| | HALFTONE | | | | | | | | | | | A | | A | 10 |
| | SOLID | | | | | | | | | | | | A | A | 10 |

FIG. 16

| | | Y | | | M | | | C | | | K | | | DENSITY INFORMATION | RELIABILITY |
|---|---|---|---|---|---|---|---|---|---|---|---|---|---|---|---|
| | | HIGHLIGHT | HALFTONE | SOLID | HIGHLIGHT | HALFTONE | SOLID | HIGHLIGHT | HALFTONE | SOLID | HIGHLIGHT | HALFTONE | SOLID | | |
| | | 9 | 10 | 8 | 10 | 9 | 10 | | 10 | 8 | | 10 | 10 | | |
| Y | HIGHLIGHT | | | | A | | | | A | | | | | A | 9 |
| | HALFTONE | | A | | A | A | | | | A | | | | A | 10 |
| | SOLID | | | | | | A | A | | | | | | A | 8 |
| M | HIGHLIGHT | A | A | | A | | | | | | | | | A | 10 |
| | HALFTONE | | A | | | | | | A | | | | | A | 9 |
| | SOLID | | | A | | | A | | A | | | | | A | 10 |
| C | HIGHLIGHT | A | | | | | | | | | | | | B | 6 |
| | HALFTONE | A | | | | A | A | | A | | | | | A | 10 |
| | SOLID | | A | | | | | | | | A | | | A | 8 |
| K | HIGHLIGHT | | | | | | | | | A | | | | B | 6 |
| | HALFTONE | | | | | | | | | | | A | | A | 10 |
| | SOLID | | | | | | | | | | | | A | A | 10 |

FIG. 17

IMAGE FORMING SYSTEM, IMAGE FORMING APPARATUS, TONE CORRECTION METHOD, NON-TRANSITORY RECORDING MEDIUM STORING COMPUTER READABLE TONE CORRECTION PROGRAM, AND IMAGE DENSITY CORRECTION METHOD

CROSS REFERENCE TO RELATED APPLICATIONS

The present invention claims priority under 35 U.S.C. § 119 to Japanese Patent Application No. 2016-159908 filed Aug. 17, 2016, and Japanese Application No. 2016-171698, filed Sep. 2, 2016, the entire content of which are incorporated herein by reference.

BACKGROUND

1. Technological Field

The present invention relates to an image forming system, an image forming apparatus, a tone correction method, a non-transitory recording medium storing a computer readable tone correction program, and an image density correction method.

2. Description of the Related Art

Conventionally, in a color image forming apparatus utilizing an electrophotographic process technology (such as a copier, a printer, or a facsimile machine), an intermediate transfer system using an intermediate transfer member such as an intermediate transfer belt is normally adopted. In the intermediate transfer system, toner images in the respective colors of cyan (C), magenta (M), yellow (Y), and black (K) formed on photoconductor drums are transferred onto an intermediate transfer member (this process is the primary transfer process). After the toner images in the four colors are superimposed on one another on the intermediate transfer member, the resultant image is transferred onto a sheet (this process is the secondary transfer process).

In such a conventional image forming apparatus, density reproducibility is required so as to faithfully reproduce the densities of images. Such density reproducibility varies with environmental changes such as changes in temperature and humidity, and also varies with degradation of components of the image forming apparatus. Therefore, to maintain density reproducibility over a long period of time in an image forming apparatus, it is necessary to regularly perform a tone correction (density correction) process for automatically correcting parameters related to tones in an image forming section.

Some conventional image forming apparatuses output a sheet for correction called a test print, for example, and cause an image reading section to read the sheet. By doing so, such an image forming apparatus creates correction patches, and performs toner correction. Such an image forming apparatus creates correction patches, and outputs the correction patches as test print images. This leads to extra toner consumption. Further, in a case where a job is interrupted due to toner correction, productivity becomes lower.

In view of the above problem, a technique disclosed in Japanese Patent Application No. 2008-224845 (hereinafter, referred to as "PTL 1") has been suggested as an image forming apparatus that reduces toner consumption and prevents a decrease in productivity. According to the technique disclosed in PTL 1, a configuration for changing the number of patches to be created for correction is used as a method for reducing toner consumption and preventing a decrease in productivity. That is, according to the technique disclosed in PTL 1, the number of patches for correction is determined in accordance with changes in factors (temperature, humidity, time, and the like) that contribute to density fluctuations. After that, density correction is performed. Also, according to the technique disclosed in PTL 1, a patch density to be detected is a predetermined tone value (pattern), and the number of types of patterns to be created is determined from information about the factors.

According to the technique disclosed in PTL 1, however, the colors and tones that can be obtained are limited, and the color information necessary and sufficient for density correction cannot be obtained. If the color information necessary and sufficient for density correction cannot be obtained, the density correction cannot be performed with high accuracy.

Further, in an image forming apparatus, the image quality of an output image (an image that is output onto a sheet) becomes lower due to degradation of the photoconductor drums, the developer, and the like over time, and the environments (changes in temperature and humidity) surrounding the apparatus. Specifically, the tone of an input image is not faithfully reproduced in an output image. To counter this, a conventional image forming apparatus performs image stabilization control for stably reproducing the tone or the like of an input image in an output image.

In the image stabilization control, the densities of toner patterns in the respective colors of C, M, Y, and K that are output to the intermediate transfer member are detected by a photosensor, and tone correction data (a so-called gamma correction curve) is generated in accordance with a result of the detection. The tone correction data is fed back to image formation conditions such as a charging potential, a developing potential, and an exposure amount.

For example, PTL 1 discloses a density correction method by which the number of patch images to be used in correction is determined in accordance with changes in factors such as temperature, humidity, and time that contribute to density fluctuations, and the densities of created patch images are detected. Density correction is performed in accordance with the result of the detection.

However, the density correction disclosed in PTL 1 requires a long time to create patch images, and might cause a decrease in productivity. Also, the patch image creation leads to an increase in toner consumption.

SUMMARY

An object of the present invention is to provide an image forming system that can perform tone correction with high accuracy while reducing toner consumption and preventing a decrease in productivity, an image forming apparatus, a tone correction method, a computer-readable recording medium storing a tone correction program, and an image density correction method.

To achieve at least one of the above-mentioned objects, an image forming system reflecting one aspect of the present invention includes a plurality of units, the units including an image forming apparatus having an image forming section that forms a toner image on an image bearing member in accordance with input image data, the image forming system including: a density detecting section configured to detect a density of the toner image formed on the image bearing member by the image forming section, the density being detected as an output image density; a hardware processor which performs; tone correction in accordance with input-output characteristics data indicating a relationship between an input image density and an output image density, the input image density being an image density of a tone component included in the input image data, the output image density being detected by the density detecting section in accordance with the tone component; determining whether there is a missing tone component in the input image data; and complementing the input-output characteristics data corresponding to the missing tone component, when it is determined that there is the missing tone component.

An image forming apparatus reflecting another aspect of the present invention includes: an image forming section configured to form a toner image on an image bearing member in accordance with input image data; a density detecting section configured to detect a density of the toner image formed on the image bearing member by the image forming section, the density being detected as an output image density; a hardware processor which performs; tone correction in accordance with input-output characteristics data indicating a relationship between an input image density and an output image density, the input image density being an image density of a tone component included in the input image data, the output image density being detected by the density detecting section in accordance with the tone component; determining whether there is a missing tone component in the input image data; and complementing the input-output characteristics data corresponding to the missing tone component, when it is determined that there is the missing tone component.

A tone correction method reflecting another aspect of the present invention includes: forming a toner image on an image bearing member in accordance with input image data; detecting a density of the toner image formed on the image bearing member; performing tone correction in accordance with input-output characteristics data indicating a relationship between an input image density and an output image density, the input image density being represented by the input image data, the output image density being represented by a result of detection of the density of the toner image; determining whether there is a missing tone component in the input image data; and complementing the input-output characteristics data corresponding to the missing tone component, when it is determined that there is the missing tone component.

A non-transitory recording medium storing a computer readable tone correction program reflecting another aspect of the present invention, the program being for causing a computer to perform: a process of forming a toner image on an image bearing member in accordance with input image data; a process of detecting a density of the toner image formed on the image bearing member; a process of performing tone correction in accordance with input-output characteristics data indicating a relationship between an input image density and an output image density, the input image density being represented by the input image data, the output image density being represented by a result of detection of the density of the toner image; a process of determining whether there is a missing tone component in the input image data; and a process of complementing the input-output characteristics data corresponding to the missing tone component, when it is determined that there is the missing tone component.

An image forming apparatus reflecting another aspect of the present invention includes: an image forming section configured to form a first output image in accordance with first image data; a density detecting section configured to detect a density of the first output image formed by the image forming section; and a hardware processor performs density correction in accordance with a result of detection performed by the density detecting section, in which the hardware processor calculates a result of detection in a second output image in accordance with the result of the detection in the first output image by the density detecting section, and performs the density correction using a result of calculation, the result of the detection in the second output image being performed by the density detecting section on the assumption that the second output image is formed by the image forming section in accordance with second image data including color information not included in the first image data.

An image forming system reflecting still another aspect of the present invention includes a plurality of units including the above image forming apparatus.

An image density correction method reflecting yet another aspect of the present invention includes: forming a first output image in accordance with first image data; detecting a density of the formed first output image; performing density correction in accordance with a result of the detection when the first image data includes color information, and when the first image data does not include color information, calculating a result of detection in a second output image in accordance with the result of detection in the first output image, on the assumption that the second output image is formed in accordance with second image data including the color information not included in the first image data, and performing the density correction using a result of calculation.

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention, and wherein:

FIG. 6A shows a detection state of an output image detected at a predetermined timing; FIG. 6B shows a detection state of an output image detected at another timing;

FIG. 14 is a table showing a 3D-LUT;

FIG. 15 is a table showing entry fields divided by the tones of primary colors;

FIG. 16 is a table showing a designated tone of a monochrome image calculated from the tones of multicolor images and the tones of monochrome images;

FIG. 17 is a table showing a designated tone of a monochrome image calculated from the tone of a multicolor image and the pre-calculated tone of a monochrome image;

DETAILED DESCRIPTION OF EMBODIMENTS

Hereinafter, one or more embodiments of the present invention will be described with reference to the drawings. However, the scope of the invention is not limited to the disclosed embodiments.

In the embodiments described below, a case where the present invention is applied to an image forming apparatus, such as a copier, a printer, or a facsimile machine, will be described. In this specification, the term "density" may be rephrased as "tone", and the term "tone" may be rephrased as "density" in some cases.

The following is a detailed description of an embodiment of an image forming apparatus, with reference to the accompanying drawings.

Figure 1:
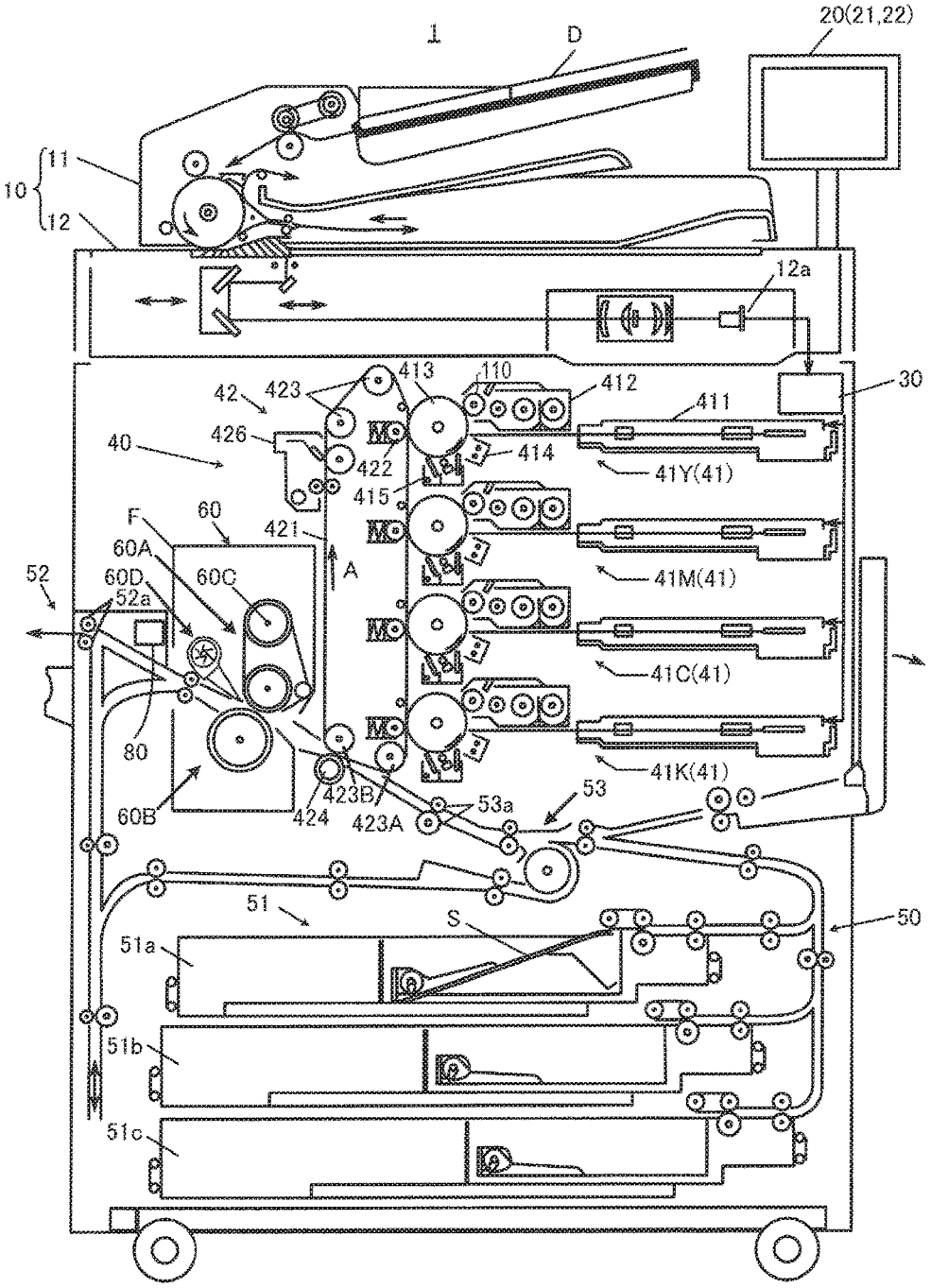
FIG. 1 is a diagram schematically showing the structure of an entire image forming apparatus according to Embodiment 1.
Figure 2:
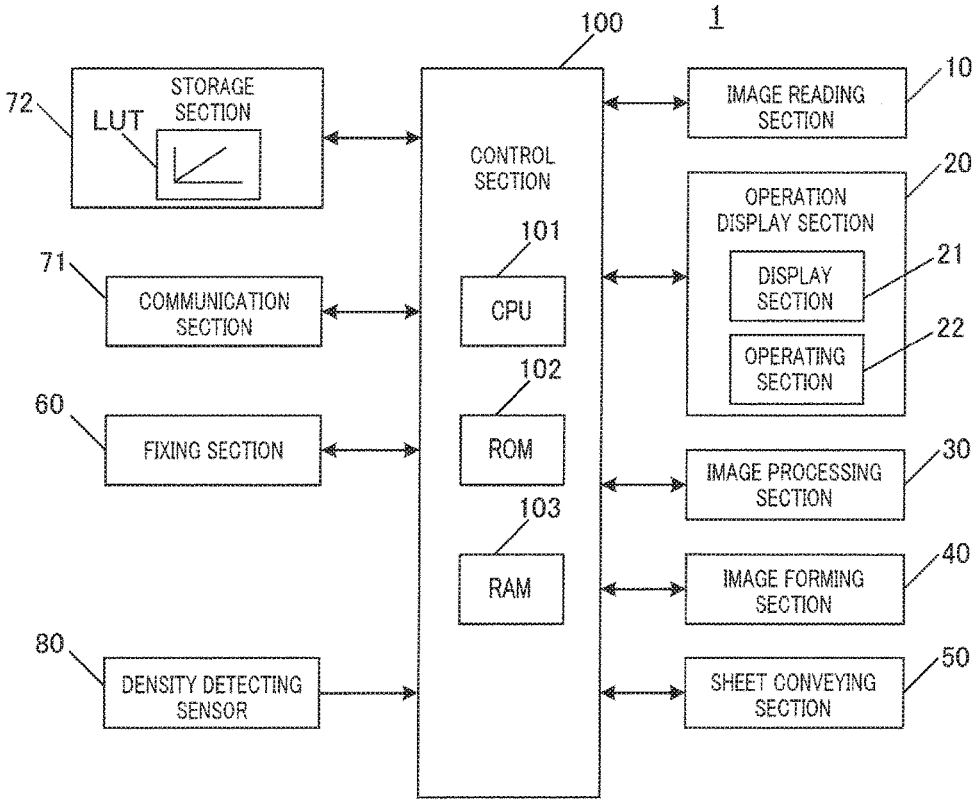
FIG. 2 is a diagram showing the principal components of a control system of the image forming apparatus according to Embodiment 1.

FIG. 1 is a diagram schematically showing the structure of an entire image forming apparatus 1 according to Embodiment 1. FIG. 2 shows the principal components of a control system of image forming apparatus 1 according to Embodiment 1. Image forming apparatus 1 shown in FIGS. 1 and 2 is a color image forming apparatus of an intermediate transfer system utilizing an electrophotographic process technology. Specifically, image forming apparatus 1 transfers toner images in the respective colors yellow (Y), magenta (M), cyan (C), and black (K) formed on photoconductor drums 413 to intermediate transfer belt 421 in a primary transfer process. After the toner images in the four colors are superimposed on one another on intermediate transfer belt 421, the toner images are transferred to sheet S in a secondary transfer process, to form a toner image.

In image forming apparatus 1, a tandem system is adopted. In this tandem system, photoconductor drums 413 corresponding to four colors of Y, M, C, and K are arranged in series in the running direction of intermediate transfer belt 421, and the toner images in the respective colors are sequentially transferred onto intermediate transfer belt 421 in a single process.

As shown in FIG. 2, image forming apparatus 1 includes image reading section 10, operation display section 20, image processing section 30, image forming section 40, sheet conveying section 50, fixing section 60, density detecting sensor 80, and control section 100.

Control section 100 includes central processing unit (CPU) 101, read only memory (ROM) 102, and random access memory (RAM) 103. CPU 101 reads a program corresponding to the details of processing from ROM 102, loads the program into RAM 103, and centrally controls operation of each of the blocks in image forming apparatus 1 in accordance with the loaded program. At this point of time, various kinds of data stored in storage section 72 are referred to. Storage section 72 is formed with a nonvolatile semiconductor memory (a so-called flash memory) or a hard disk drive, for example.

In Embodiment 1, control section 100 functions as the tone correcting section, the determining section, and the complementing section of the present invention.

Control section 100 transmits/receives various kinds of data to/from an external apparatus (such as a personal computer) connected to a communication network, such as a local area network (LAN) or a wide area network (WAN), via communication section 71. For example, control section 100 receives image data transmitted from an external apparatus, and performs control so that a toner image based on the image data (input image data) is formed on sheet S. Communication section 71 is formed with a communication control card, such as a LAN card.

Image reading section 10 includes automatic document feeder 11 called an auto document feeder (ADF) and document image scanner 12 (a scanner).

Automatic document feeder 11 conveys document D placed on a document tray with a conveyance mechanism, and sends document D to document image scanner 12. Automatic document feeder 11 can successively read (both sides of) images of a large number of documents D placed on the document tray in one operation.

Document image scanner 12 optically scans a document conveyed onto a contact glass from automatic document feeder 11 or a document placed on the contact glass, forms an image with light reflected from the document on the light receiving surface of charge coupled device (CCD) sensor 12*a*, and reads the document image. Image reading section 10 generates input image data in accordance with a result of the reading performed by document image scanner 12. The input image data is subjected to predetermined image processing at image processing section 30.

Operation display section 20 is formed with a liquid crystal display (LCD) equipped with a touch panel, and functions as display section 21 and operating section 22. Display section 21 displays various operation screens, image statuses, operation statuses of the respective functions, and the like, in accordance with display control signals input from control section 100. Operating section 22 includes various operation keys, such as a numeric key pad and a start key. Operating section 22 accepts various input operations conducted by the user, and outputs operation signals to control section 100.

Image processing section 30 includes a circuit or the like that performs digital image processing on the input image data, in accordance with initial settings or user settings. For example, under the control of control section 100, image processing section 30 performs tone correction in accordance with tone correction data (tone correction table LUT) in storage section 72. This tone correction process will be described later in detail. In addition to the tone correction, image processing section 30 performs various correction processes such as color correction and shading correction, and a compression process or the like, on the input image data. Image forming section 40 is controlled in accordance with the image data subjected to these processes.

Image forming section 40 includes image forming units 41Y, 41M, 41C, and 41K for forming images with respective color toners of the Y component, the M component, the C component, and the K component in accordance with the input image data, and intermediate transfer unit 42.

Image forming units 41Y, 41M, 41C, and 41K for the Y component, the M component, the C component, and the K component have the same structures. For ease of illustration and explanation, like components are denoted by like reference numerals, and the reference numerals are accompanied by Y, M, C, or K when the components need to be distinguished from one another. In FIG. 1, only the components of image forming unit 41Y for the Y component are denoted by reference numerals, and any reference numerals are not shown to denote the components of other image forming units 41M, 41C, and 41K.

Image forming unit 41 includes exposing device 411, developing device 412, photoconductor drum 413, charging device 414, and drum cleaning device 415.

Exposing device 411 includes an LED array in which light-emitting diodes (LEDs) are linearly arranged, an LPH driver (driver I) for driving the respective LEDs, and an LED print head having a lens array for forming an image with light emitted from the LED array on photoconductor drum 413. One LED of the LED array corresponds to one dot of the image.

Exposing device 411 irradiates photoconductor drum 413 with light corresponding to the image in the corresponding color component. The positive charge generated in the charge generation layer of photoconductor drum 413 at a time of irradiation with light is transported to the surface of the charge transport layer, so that the surface charge (negative charge) of photoconductor drum 413 is neutralized. As a result, an electrostatic latent image of the corresponding color component is formed on the surface of photoconductor drum 413 due to a potential difference from the surrounding portion.

Developing device 412 houses a developer of the corresponding color component (a two-component developer formed with a toner and a magnetic carrier). Developing device 412 visualizes the electrostatic latent image by attaching the toner of the corresponding color component to the surface of photoconductor drum 413, and thus, forms a toner image. Specifically, a developing bias voltage is applied to developing roller 110, and an electric field is formed between photoconductor drum 413 and developing roller 110. Due to a potential difference between photoconductor drum 413 and developing roller 110, the charged toner on developing roller 110 moves to the exposed portion on the surface of photoconductor drum 413 and adheres thereto.

Photoconductor drum 413 is a negatively-charged organic photoconductor (OPC) that has an under-coat layer (UCL), a charge generation layer (CGL), and a charge transport layer (CTL) stacked in this order on the surface of a conductive cylindrical member made of aluminum (an aluminum tube) with a drum diameter of 80 mm. The charge generation layer is made of an organic semiconductor in which a charge generation material (a phthalocyanine pigment, for example) is dispersed in a resin binder (polycarbonate, for example), and generates a pair of positive and negative charges through light exposure performed by exposing device 411. The charge transport layer is made of a material in which a hole transport material (an electron-donating nitrogen-containing compound) is dispersed in a resin binder (polycarbonate resin, for example), and transports the positive charge generated in the charge generation layer to the surface of the charge transport layer.

Control section 100 controls a drive current supplied to a drive motor (not shown) that rotates photoconductor drum 413, so that photoconductor drum 413 is rotated at a constant circumferential speed.

Charging device 414 negatively and uniformly charges the surface of photoconductor drum 413 having photoconductivity. Exposing device 411 is formed with a semiconductor laser, for example, and irradiates photoconductor drum 413 with laser light corresponding to the image of the corresponding color component. A positive charge is generated in the charge generation layer of photoconductor drum 413, and is transported to the surface of the charge transport layer, so that the surface charge (negative charge) of photoconductor drum 413 is neutralized. Because of a potential difference from the surrounding portion, an electrostatic latent image of the corresponding color component is formed on the surface of photoconductor drum 413.

Developing device 412 is a developing device of a two-component development type, for example, and applies a toner of the corresponding color component to the surface of photoconductor drum 413, to visualize the electrostatic latent image and form a toner image.

Drum cleaning device 415 has a drum cleaning blade or the like that is in sliding contact with the surface of photoconductor drum 413, and removes residual transferred toner remaining on the surface of photoconductor drum 413 after the primary transfer.

Intermediate transfer unit 42 includes intermediate transfer belt 421 as an image bearing member, primary transfer roller 422, support rollers 423, secondary transfer roller 424, and belt cleaner 426.

Intermediate transfer belt 421 is formed with an endless belt, and is stretched like a loop around support rollers 423. At least one of support rollers 423 is formed with a driving roller, and the others are formed with driven rollers. For example, roller 423A located on the downstream side of primary transfer roller 422 for the K component in the belt running direction is preferably a driving roller. With this, the running speed of the intermediate transfer belt 421 at the primary transfer section can be easily kept at a constant speed. As driving roller 423A rotates, intermediate transfer belt 421 moves at a constant speed in the direction of arrow A.

Primary transfer roller 422 is disposed on the inner peripheral surface side of intermediate transfer belt 421 so as to face photoconductor drum 413 of the corresponding color component. With intermediate transfer belt 421 being interposed in between, primary transfer roller 422 is pressed against photoconductor drum 413, so that a primary transfer nip for transferring a toner image from photoconductor drum 413 to intermediate transfer belt 421 is formed.

Secondary transfer roller 424 is disposed on the outer peripheral surface side of intermediate transfer belt 421 so as to face backup roller 423B disposed on the downstream side of driving roller 423A in the belt running direction. With intermediate transfer belt 421 being interposed in between, secondary transfer roller 424 is pressed against backup roller 423B, so that a secondary transfer nip for transferring the toner image from intermediate transfer belt 421 to sheet S is formed.

When intermediate transfer belt 421 passes through the primary transfer nip, the toner images on the photoconductor drums 413 are sequentially superimposed and transferred onto the intermediate transfer belt 421 in the primary transfer process. Specifically, a primary transfer bias is applied to primary transfer roller 422, and a charge having a polarity opposite to that of the toner is applied to the back side of intermediate transfer belt 421 (the side in contact with primary transfer roller 422), so that the toner image is electrostatically transferred onto intermediate transfer belt 421.

After that, when sheet S passes through the secondary transfer nip, the toner image on intermediate transfer belt 421 is transferred onto sheet S in the secondary transfer process. Specifically, a secondary transfer bias is applied to the secondary transfer roller 424, and a charge having a polarity opposite to that of the toner is applied to the back side of sheet S (the side in contact with secondary transfer roller 424), so that the toner image is electrostatically transferred onto sheet S. Sheet S onto which the toner image has been transferred is conveyed toward fixing section 60.

Belt cleaner 426 has a belt cleaning blade or the like in sliding contact with the surface of intermediate transfer belt 421, and removes residual transferred toner remaining on the surface of intermediate transfer belt 421 after the secondary transfer. Instead of secondary transfer roller 424, a structure in which a secondary transfer belt is stretched in a loop around support rollers including a secondary transfer roller may be adopted (this structure is called a belt-type secondary transfer unit).

Fixing section 60 includes upper fixing section 60A having a fixing surface side member disposed on the side of the fixing surface (the surface on which a toner image is formed) of sheet S, lower fixing section 60B having a back-side support member disposed on the side of the back surface (the surface opposite from the fixing surface) of sheet S, and heat source 60C. As the back-side support member is pressed against the fixing surface side member, a fixing nip for nipping and conveying sheet S is formed.

Fixing section 60 heats and presses, at the fixing nip, sheet S that has a toner image transferred thereonto in the secondary transfer process and has been conveyed to fixing section 60. By doing so, fixing section 60 fixes the toner image to sheet S. Fixing section 60 is provided as a unit in fixing device F. Air separation unit 60D that separates sheet S from the fixing surface side member by blowing air is further provided in fixing device F.

Sheet conveying section 50 includes sheet feeding section 51, sheet ejecting section 52, and conveyance path section 53. Sheets S (standard paper and special paper) identified in accordance with basis weights, sizes, and the like are classified into predetermined types and are stored in three sheet feed tray units 51*a* through 51*c* constituting sheet feeding section 51. Conveyance path section 53 includes conveyance roller pairs such as registration roller pair 53*a*.

Sheets S stored in sheet feed tray units 51*a* through 51*c* are sent one by one from the uppermost portion and are conveyed to image forming section 40 by conveyance path section 53. At this point of time, the inclination of the fed sheet S is corrected and the conveyance timing is adjusted by the registration roller portion provided with registration roller pair 53*a*. In image forming section 40, the toner image on intermediate transfer belt 421 is then transferred collectively to one side of sheet S in the secondary transfer process. In fixing section 60, a fixing step is carried out. Sheet S on which an image has been formed is ejected to the outside of the apparatus by sheet ejecting section 52 that includes sheet ejection rollers 52*a*.

Density detecting sensor 80 detects the density of an image formed on sheet S serving as an image bearing member. In this embodiment, density detecting sensor 80 is an optical sensor that includes light-emitting elements (for example, infrared LED arrays that emit infrared light) as light-emitting sections that emit light, and a light receiving element (a photodiode, for example) as a light receiving section that receives the light that is reflected.

Density detecting sensor 80 operates in accordance with a control signal from control section 100, and outputs the density value of an image formed on a sheet as density data to control section 100.

In this embodiment, density detecting sensor 80 is disposed on the downstream side of fixing section 60 and on the upstream side of sheet ejecting section 52. Density detecting sensor 80 is disposed so that the infrared LED arrays are located in the width direction of sheet S (a direction orthogonal to the conveyance direction).

Density detecting sensor 80 irradiates sheet S having an image formed thereon with infrared light emitted from each of the infrared LED arrays, receives the reflected light with the photodiode, and outputs an electrical signal corresponding to the amount of the received light (the density of the image on sheet S) as a toner density detection signal.

(Tone Correction Process)

Meanwhile, in a case where tone correction is performed in image forming apparatus 1, the following problems arise: the toner consumption increases as the number of correction patches to be created becomes larger; and productivity drops when a job is interrupted. Therefore, when tone correction is performed, it is preferable to reduce the number of correction patches to be created, and perform tone correction without any job interruption.

In view of the above problems, image forming apparatus 1 of this embodiment determines whether there is a missing tone component (hereinafter referred to as a "missing tone") from density information about an input image and the actual image. If it is determined that there is a missing tone, a correction patch is created, and tone correction is performed.

In this embodiment, tone correction is performed in the following manner: a patch image for tone correction is formed on an image bearing member, the density of the patch image is read with density detecting sensor 80, and tone correction is performed in accordance with a result of the reading.

Further, in image forming apparatus 1, when tone correction is performed, the number of patches for tone correction (hereinafter also simply referred to as "patches") to be created is reduced, and the tone correction is performed without any job interruption.

Figure 3:
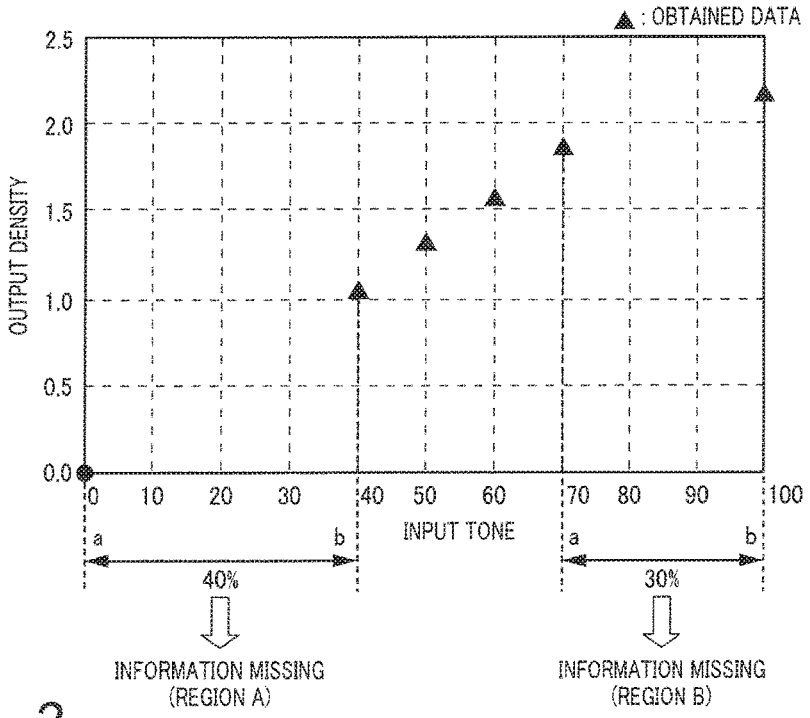
FIG. 3 is a graph for explaining a data complementing process in Embodiment 1, and shows an example of input-output characteristics data prior to correction patch creation.
Figure 4:
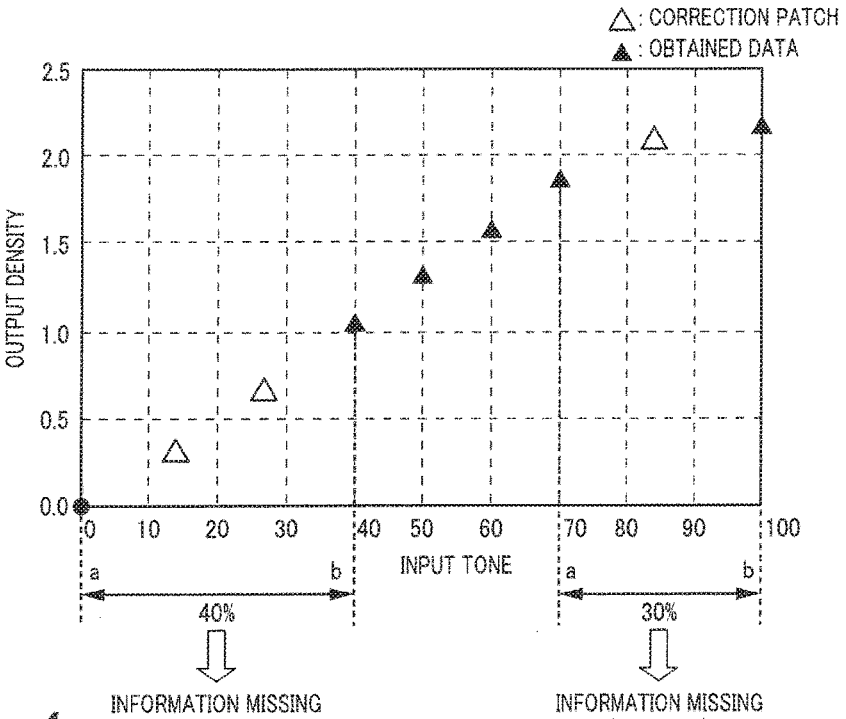
FIG. 4 is a graph for explaining a data complementing process in Embodiment 1, and shows a result of complementing of input-output characteristics data.

Referring now to FIGS. 3 and 4, a process of determining whether there is a missing tone, a patch creation process, and a tone correction process are described. In the description below, a tone correction process to be performed on an image printed in a single color (with a K component toner, for example) is described. However, a similar process can also be performed on images in other colors (with Y, M, and C component toners, for example).

FIG. 3 schematically shows an example of an input tone-output density characteristics table (input-output characteristics data) obtained by plotting density information about an actual image, or a toner image, detected by density detecting sensor 80. The input tone-output density characteristics table shows the relationship between the input image density that is the image density of the tone component included in an input image data and the output image density detected in accordance with the tone component by density detecting sensor 80.

In the example shown in FIG. 3, the abscissa axis (input tone) indicates the tone value corresponding to the density information (image density) included in the input image data. Meanwhile, the ordinate axis (output density) indicates the output density value of the toner image detected by density detecting sensor 80.

One of the points (five points in this example) indicated by black triangles "▲" in the table corresponds to one of the pixels (dots) in the toner image detected by density detecting sensor 80. Each of these points is represented by associating an "output density" detected by density detecting sensor 80 with the tone corresponding to the density information included in the input image data, which is an "input tone".

The data of each point ("▲") in the input tone-output density characteristics table is generated or plotted on the table by obtaining an input tone that is the tone value corresponding to the density information about the input image data at a predetermined coordinate position of the toner image (pixel) on sheet S at which the output density value is detected with density detecting sensor 80, and obtaining the output tone of image forming section 40 corresponding to the tone value.

As for the tone values of input tones, it is assumed that the tone value corresponding to the lowest image density (white) is 0, and the tone value corresponding to the highest image density (black) is 100, for ease of illustration and explanation. As for the tone width range (tone width), the ratio of a tone value to the greatest tone value will be described in terms of percentage (%).

It should be noted that the number of tones or the tone range (tone width) to be used in image forming section 40 is not limited to any particular number or range, and any appropriate number of tones, such as 16 tones or 256 tones, can be used.

In FIG. 3, five pieces of information, "1.1", "1.3", "1.6", "1.8", and "2.2", are detected as output densities by density detecting sensor 80, and tone values "40", "50", "60", "70", and "100" are obtained for the results of the detection.

As can be seen from the example shown in FIG. 3, the tone ranges of input tones in two regions, which are the region from tone value 0 to tone value 40 (this region will be hereinafter referred to as region A) and the region from tone value 70 to tone value 100 (this region will be hereinafter referred to as region B) are insufficient compared with the other regions, or are missing. In other words, the distribution of tone ranges in the output image is uneven.

Here, control section 100 (determining section) calculates a difference in tone value (a tone difference) between two adjacent tones in the density information detected by density detecting sensor 80. In other words, the tone difference is the tone width corresponding to a region from which density information is not detected as a result of image density detection performed by density detecting sensor 80 (this region is a density information non-detection region).

In the example shown in FIG. 3, control section 100 calculates the tone difference in region A to be 40−0="40", calculates the tone difference in region B to be 100−70="30", and calculates the tone difference in each of the other three regions to be "10".

Control section 100 then determines whether the calculated tone difference or tone width is equal to or greater than a predetermined value (predetermined width), and, if the tone difference is equal to or greater than the predetermined value, determines that there is a missing tone component in the region, or the region is a missing tone.

In this case, control section 100 controls image forming section 40 to form a patch image of a correction patch for the region with such a missing tone, in the margin of sheet S, for example. In accordance with a result of detection performed by density detecting sensor 80 that has detected the density of the patch image, control section 100 performs a process of complementing the above described input-output characteristics data (see "Δ" in FIG. 4).

In the example shown in FIGS. 3 and 4, if the threshold value is set at 20(%), control section 100 determines that there are missing tones in regions A and B described above.

In a case where the threshold value is set at another value, if the threshold value is set at 35(%), for example, control section 100 determines that there is a missing tone component only in region A described above. If the threshold value is set at 45(%), control section 100 determines that there are no missing tone components. In the description below, a case where the threshold is set at 20% is explained.

When determining that there is a missing tone component, control section 100 performs the calculation described below, to determine the number of correction patches to be created (or the number of complements).

For each region determined to have a missing tone component (missing output image information), control section 100 calculates (C-1) the number of correction patches to be complemented (the number of correction patches), (C-2) the interval between the correction patches to be complemented (correction patch tone width), and (C-3) the tone values of the correction patches to be complemented (correction patch tone values).

These are calculated according to the arithmetic expressions shown below.

$$\text{Number of correction patches} = |\text{difference}/\text{threshold}| \quad \text{(C-1)}$$

$$\text{Correction patch tone width} = \text{difference}/(\text{number of correction patches}+1) \quad \text{(C-2)}$$

$$\text{Correction patch tone value} = a + \text{correction patch tone width} \quad \text{(C-3)}$$

Here, "difference" is the difference between the greatest tone value and the smallest tone value in the tone range (region) determined to have a missing tone. Further, "a" is the smallest tone value in a tone range (region) determined to have a missing tone. Where the "threshold value" is small, the number of correction patches is large. Where the "threshold value" is large, the number of correction patches is small.

In this example, since the threshold value is set at 20(%), the number of correction patches in region A in FIG. 3 is calculated to be $|(40-0)/20|=2$. On the other hand, the number of correction patches in region B is calculated to be $|(100-70)/20|=1$.

Control section 100 then assigns the tone values in the missing tone area to the calculated number of correction patches. Here, control section 100 equally assigns tone values to the respective correction patches in the missing tone region (see FIG. 4), and controls image forming section 40 to form a patch image on sheet S (in the margin of sheet S, for example) with the assigned tone values.

In this example, patch images with a tone value of 13 and a tone value of 26 are formed as correction patches for region A, and a patch image with a tone value of 85 is formed as a correction patch for region B.

The density of each of these patch images is detected by density detecting sensor 80, and such density information is supplied to control section 100. Control section 100, which has obtained the density values of the respective patch images, complements the input tone-output density characteristics table, using the obtained values.

FIG. 4 schematically shows a result of the complementing of the input tone-output density characteristics table. As indicated by white triangles "Δ" in FIG. 4, an output density of 0.3 and an output density of 0.6 are detected as the output densities of the two patch images (tone values 13 and 26) in region A, respectively, and an output density of 2.1 is detected as the output density of the patch image with the tone value of 85 in region B.

Control section 100 performs tone correction on image forming section 40, using the input tone-output density characteristics table complemented as above.

In this tone correction, control section 100 compares the obtained density values of the actual image and the patch images with a density reference value (reference) held by image forming apparatus 1, and, in accordance with comparison results, corrects the values in the tone correction data (tone correction table LUT) in storage section 72.

Specifically, when the detected densities of the actual image and a patch image are higher than the reference, control section 100 corrects values in tone correction table LUT so that the density of the output image becomes relatively lower and equal to the reference. Further, when the detected density of a patch image is lower than the reference, control section 100 corrects values in tone correction table LUT so that the density of the output image of the corresponding tone number becomes relatively higher and equal to the reference.

As the above described process is performed, input-output data to be used in tone correction is obtained from the actual image as much as possible, and, for a region from which such data cannot be obtained, patches are formed so as to avoid a decrease in the accuracy of tone correction, and input-output data is then obtained in this embodiment. Thus, toner consumption is reduced, and tone correction is performed with high accuracy.

(Flow in Tone Correction Process)

Figure 5:
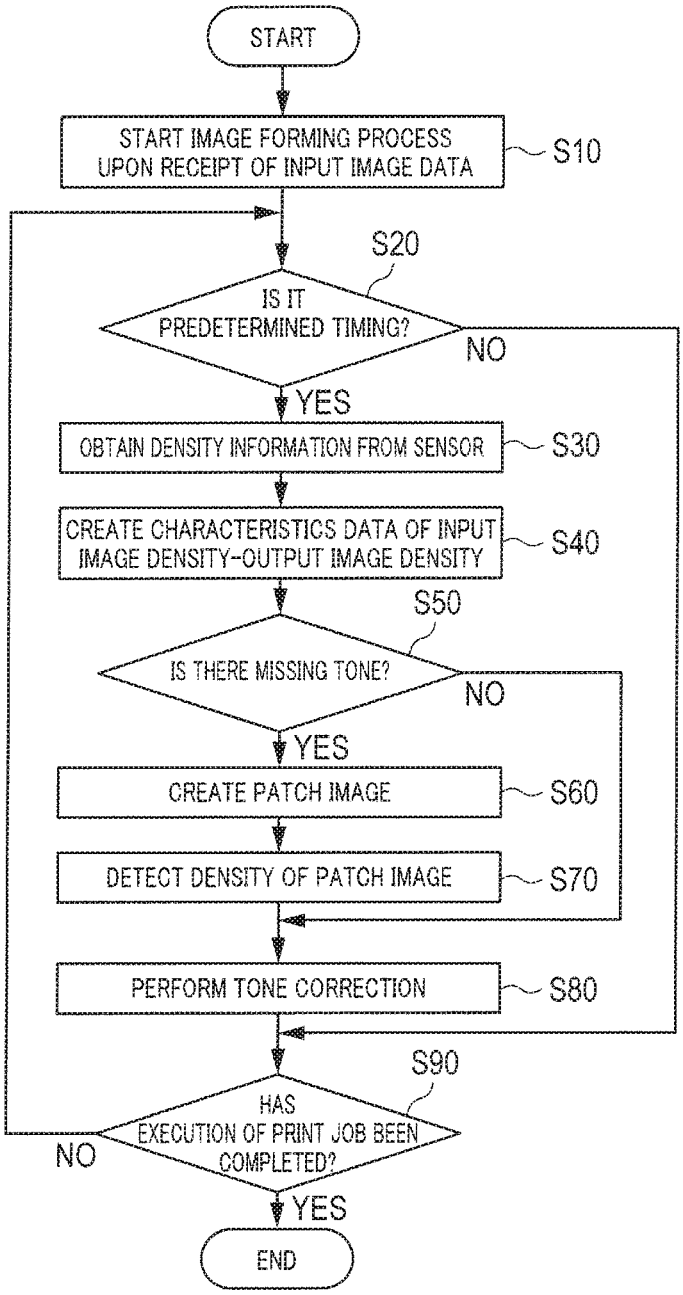
FIG. 5 is a flowchart for explaining a tone correction process in Embodiment 1.

Referring now to the flowchart in FIG. 5, the flow in a process related to tone correction is described.

Before starting an image formation process, image forming apparatus 1 receives (an input of) image data of a document (input image data) from an external apparatus, such as a PC, to form an image of the document in one print job (equivalent to one or more sheets).

At this point of time, control section 100 temporarily stores the input image data in the work area such as RAM 103 (step S10), and starts the image formation process for the equivalent number of sheets. Control section 100 also moves to step S20.

In step S20, control section 100 determines whether the timing is a preset timing (predetermined timing). In a case where the timing is the "preset timing", the sheet(s) on which an image/images is/are to be formed is/are (1) a predetermined number of sheets (a threshold number of sheets) set in advance, (2) the nth sheet in the job (the first page, the second page, or the last page, for example), or (3) past a predetermined period since the last tone correction, for example.

In the case of (1), it is possible to determine whether the timing is the preset timing, by using a sheet counter and counting the number of sheets printed since the previous tone correction. The case of (2) may be useful when printing is performed on a large number of sheets in a single job each time. In the case of (3), it is possible to determine whether the timing is the preset timing, by using a timer and measuring the time elapsed since the previous tone correction.

The predetermined timing can be set by a user, a system manager, or the like (hereinafter simply referred to as the user).

As a result of the determination, if the timing is the predetermined timing (YES in step S20), control section 100 monitors the output of density detecting sensor 80, and moves on to step S30.

If the timing is not the predetermined timing (NO in step S20), on the other hand, control section 100 does not monitor the output of density detecting sensor 80, and does not carry out step S30 and the steps that follow (various kinds of processes relating to tone correction). Instead, control section 100 moves on to step S90. In this case, control section 100 continues the image formation process until the execution of the print job is completed. When the execution of the print job is completed (YES in step S90), control section 100 returns to a state of awaiting document image data.

In step S30, control section 100 obtains the density information about an image output from density detecting sensor 80, and temporarily stores the obtained information in the work area such as RAM 103.

In step S40, control section 100 creates the input tone-output density characteristics table (input-output characteristics data) described above with reference to FIG. 3 (see FIG. 3).

In step S50, control section 100 determines whether there is a missing tone component in the input image data. The determination in step S50, which is the determination method as to whether there is a missing tone in the input image data, is as described above.

If the result of the determination in step S50 is YES, or, if there is a missing tone component, control section 100 moves to step S60.

If the result of the determination in step S50 is NO, or if it is determined that there are no missing tone components, control section 100 determines that there is no need to create a correction patch (patch image), and moves on to step S80, without performing the processes in steps S60 and S70.

In step S60, control section 100 creates a patch for correction in the region determined to have a missing tone component, performs data complementing, and also controls image forming section 40 to form a test patch image from the created (calculated) correction patch.

In such a process, a patch image (three images corresponding to "Δ" in the example shown in FIG. 4) is formed in the margin portion of sheet S serving as an image bearing member, for example.

In step S70, control section 100 monitors the density of the patch image detected by density detecting sensor 80. After obtaining the density value of the patch image, control section 100 moves on to step S80.

In step S80, which comes immediately after step 70, control section 100 complements the input tone-output density characteristics table with the obtained density value of the patch image, and, using the complemented input tone-output density characteristics table, performs tone correction on image forming section 40.

If it is determined that there are no missing tones (NO in step S50), on the other hand, control section 100 in step S80, which comes immediately after step S50, performs tone correction on image forming section 40, without creating a correction patch (patch image) and complementing the input tone-output density characteristics table. In this case, control section 100 performs tone correction as described above, using the input tone-output density characteristics table created in step S40.

In step S90, control section 100 determines whether execution of the print job has been completed. If the result is NO, or, if it is determined that the execution of the print job has not been completed, control section 100 returns to step S20, and repeats the above described processes in steps S20 through S90.

If the result in step S90 is YES, or, if it is determined that the execution of the print job has been completed, the series of processes comes to an end.

Through the above process, image forming apparatus 1 obtains input-output data to be used for tone correction. In a tone region in an actual image from which such data cannot be obtained, image forming apparatus 1 obtains input-output data by forming a patch image so as to avoid a decrease in the accuracy of tone correction. Thus, tone correction accuracy can be increased while toner consumption is reduced.

(Modifications)

The following is a description of modifications of the above described tone correction process.

In the above described embodiment, control section 100 (complementing section) performs a process of forming a patch image representing the image density of a missing tone component, and a process of complementing the input tone-output density characteristics table (input-output characteristics data) with the density information about the patch image detected by density detecting sensor 80.

In a modification of this process, control section 100 (complementing section) may complement the input-output characteristics data corresponding to a missing tone component among the input-output characteristics data used for tone correction in the past. In this case, it is possible to skip the process of patch image formation (step S60 in FIG. 5) and the process of patch image density detection (step S70 in FIG. 5). Thus, tone correction at higher speed can be performed.

In another modification, control section 100 (complementing section) may communicate with a communication section of a computer or another image forming apparatus in the network through communication section 71, and complement the input-output characteristics data corresponding to a missing tone component in the input-output characteristics data stored in such a computer or the input-output data stored in a storage section of such an image forming apparatus. In this case, it is also possible to skip the process of patch image formation (step S60 in FIG. 5) and the process of patch image density detection (step S70 in FIG. 5). Thus, tone correction at higher speed can be performed.

In the above described embodiment, the determination as to whether there is a missing tone component (step S50 in FIG. 5) is made in accordance with a result of determination as to whether the difference in tone value between two adjacent tones in the density information detected by density detecting sensor 80.

In a modification of this process, control section 100 (determining section) may determine whether there is a missing tone by determining whether an input image tone coverage ratio that is the ratio of the total number of tones represented by the input image data to the total number of tones in a toner image that can be formed by image forming section 40 is equal to or lower than a threshold value (a predetermined coverage ratio).

Here, the threshold value is a desired value that has been set in advance, and can be set (changed) to any appropriate value by the user.

More specifically, where the total number of tones in a toner image that can be formed by image forming section 40 is 100 while the total number of tones represented by the input image data is 60, for example, the input image tone coverage ratio is 60/100=60(%). In a case where the threshold value is 50, for example, the input image tone coverage ratio exceeds the threshold value (predetermined coverage ratio), and it is determined that there are no missing tones. In a case where the threshold value is 70, for example, the input image tone coverage ratio does not exceed the threshold value (predetermined coverage ratio), and it is determined that there is a missing tone.

In another modification of determination as to whether there is a missing tone, control section 100 (determining section) may determine whether the number of tones in the density of the toner image detected by density detecting sensor 80 at a predetermined timing is equal to or larger than a predetermined number of tones. By doing so, control section 100 may determine whether there is a missing tone component.

Here, the "predetermined timing" is the timing described in step S20 of FIG. 5, and can be arbitrarily set by the user.

Further, the "predetermined number of tones" should be a number equal to or smaller than the total number of tones that can be used in the image forming section, and be a number equal to or smaller than the total number of tones used in the input image data. In this case, in regard to the "predetermined number of tones", the above described threshold value for the input image tone coverage ratio can be used.

Figure 6A:
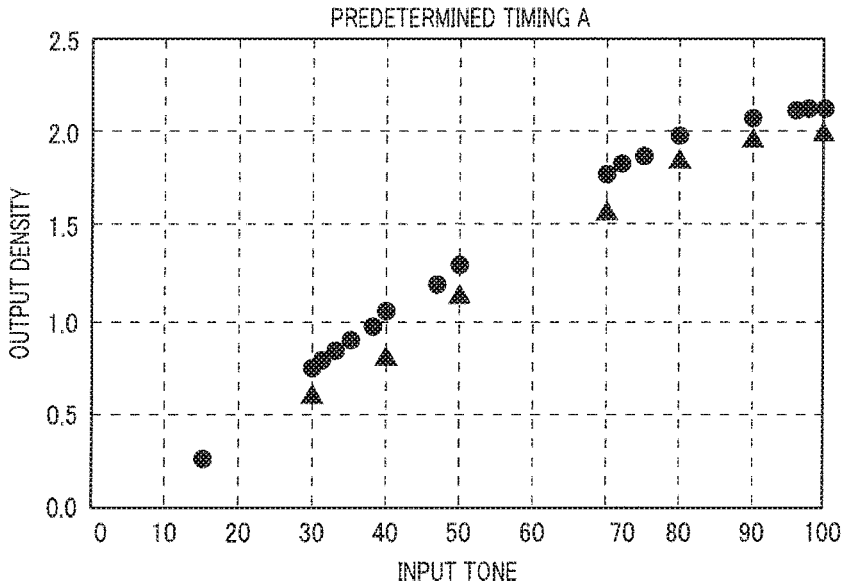
FIGS. 6A and 6B are graphs for explaining another example process related to tone correction.
Figure 6B:
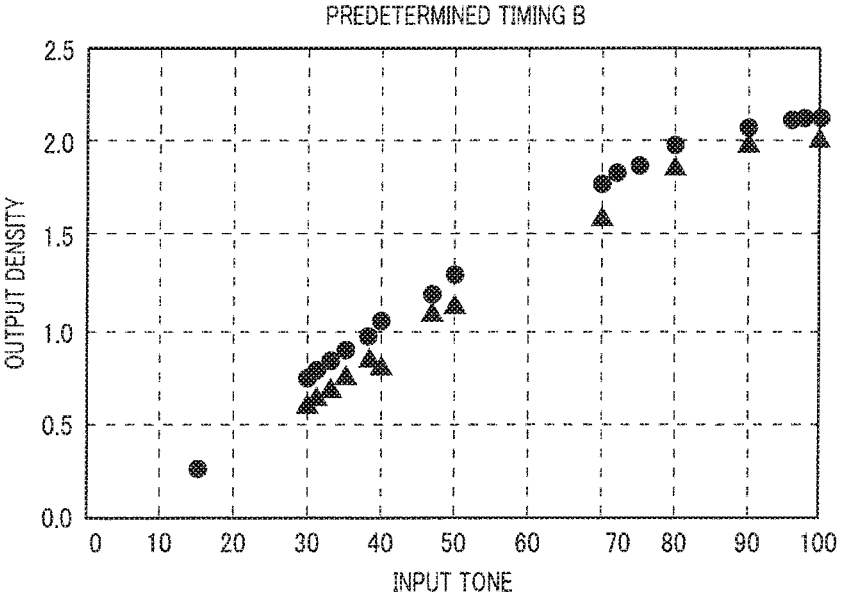

Referring now to FIG. 6 (FIGS. 6A and 6B), such a modification is described. FIG. 6 (FIGS. 6A and 6B) each schematically show the above described input tone-output density characteristics table created in step S40 in FIG. 5. In each table, black circles "●" represent data plotted on the assumption that density detecting sensor 80 detects the densities of all the images output in one print job (more than one sheet). In each table, black triangles "▲" represent data plotted in accordance with the results of detection performed by density detecting sensor 80 detecting the density of the output image at a predetermined timing during execution of the print job.

Between FIGS. 6A and 6B, the timing in step S20 in FIG. 5 is different. In other words, the timing for detecting the density of an output image with density detecting sensor 80 is different. For example, the example shown in FIG. 6A (predetermined timing A) is an example case where an image of the first page is read with density detecting sensor 80, and the example shown in FIG. 6B (predetermined timing B) is an example case where an image of the second page is read with density detecting sensor 80. As can be seen from either case, the number of pieces of density detection information (▲) about the output image is smaller than the number of those in the entire job (black circles "●").

If the total number of tones that can be used in the image forming section is 100 (or there are 100 tone levels), and the total number of tones (the number of black circles "●") represented by the input image data is 30, the input image tone coverage ratio is (30/100=) 0.3, which is 30%.

In a case where the threshold value is set at 40%, for example, the input image tone coverage ratio is equal to or lower than the threshold value. Therefore, control section 100 (determining section) determines that there is a missing tone in the input image data. In a case where the threshold value is set at 20%, for example, the coverage ratio exceeds the threshold value, and therefore, control section 100 (determining section) determines that there are no missing tones in the input image data.

In this modification, the threshold value for the ratio (input image tone coverage ratio) between the total number of tones that can be used in the image forming section and the total number of tones used in the input image data is used as the threshold value for the "predetermined number of tones", as described above.

In yet another modification, a threshold value for the ratio between the total number of tones (see the black circles "●" in FIG. 6) used in the input image data and the total number of tones (see the black triangles "▲" in FIG. 6) corresponding to the image density obtained by density detecting sensor 80 at a predetermined timing (this ratio will be hereinafter referred to as the second coverage ratio) may be used as the threshold value for the "predetermined number of tones".

In this case, if the total number of tones (the number of black circles "●") represented by the input image data is 60, and the total number of tones (the number of black triangles "▲") corresponding to the image density obtained by density detecting sensor 80 at a predetermined timing (timing B in FIG. 6B, for example) is 50, for example, the second coverage ratio is (50/60=) 0.83, which is 83%. Accordingly, in a case where the threshold value is set at 80%, for example, it is determined that there are no missing tones. In a case where the threshold value is set at 85%, for example, it is determined that there is a missing tone.

In a further modification, a threshold value for the ratio between the total number of tones that can be used in the image forming section and the total number of tones corresponding to the image density obtained by density detecting sensor 80 at a predetermined timing (this ratio will be hereinafter referred to as a third coverage ratio) may be used as the threshold value for the "predetermined number of tones".

In yet another modification, the threshold value for the "predetermined number of tones" may be set at any appropriate number that is equal to or smaller than the total number of tones that can be used in the image forming section, and is equal to or smaller than the total number of tones used in the input image data.

In the above described embodiment, if it is determined in step S50 in FIG. 5 that there is a missing tone component, a patch image is formed in step S60 so that the difference in tone value between two adjacent tones in the density information detected by density detecting sensor 80 becomes smaller than a predetermined value.

In a modification of this process, if it is determined in step S50 that there is a missing tone component, control section 100 may perform a process of forming a patch image in step S60 so as to obtain a value that exceeds the above described predetermined coverage ratio (the input image tone coverage ratio, the second coverage ratio, or the third coverage ratio) or the predetermined number of tones.

Figure 7:
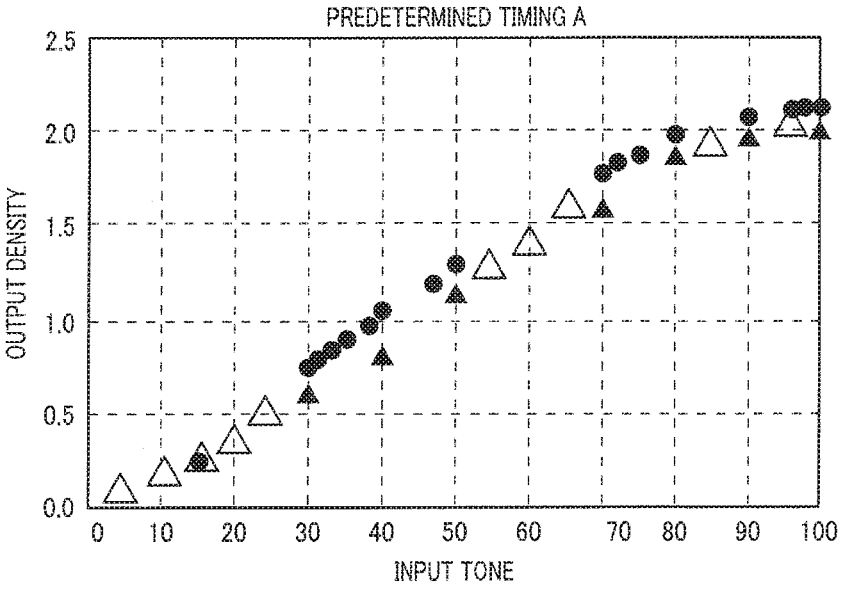
FIG. 7 shows an example of input-output characteristics data for explaining another example process related to tone correction.

Referring now to FIG. 7, this process is described. FIG. 7 is a table corresponding to FIG. 6A, and schematically shows an input tone-output density characteristics table. In the table, black circles "●" represent data plotted on the assumption that density detecting sensor 80 detects the densities of all the images output in one print job (more than one sheet), as in the above described modification. Black triangles "▲" represent data plotted in accordance with the results of detection performed by density detecting sensor 80 detecting the density of the output image at timing A during execution of the print job.

The process is based on the assumption that a threshold value 40(%) for the above described third coverage ratio is set as the threshold value for the "predetermined number of tones", the total number of tones that can be used in the image forming section is 100, and the total number of tones (the number of black triangles "▲") corresponding to the image density obtained by density detecting sensor 80 at timing A is 30. In FIG. 7, the number of black triangles ▲ is smaller than 30, to conform to FIG. 6A.

In this example, the ratio of the total number (30) of tones corresponding to the image density obtained by density detecting sensor 80 at timing A to the total number (100) of tones that can be used in the image forming section, or the third coverage ratio, is calculated to be (30/100=) 30%.

In this case, the third coverage ratio is lower than the threshold value (40). Therefore, control section 100 determines in step S50 that there is a missing tone, and in the next step S60, performs a process of forming patch images that are equal to or larger in number than the threshold value. In this example, patch images equivalent to (40-30=) 10%, or ten patch images, are formed to be equal in number to the threshold value. The processes in step S70 and the steps that follow are the same as those described above.

In the above described embodiment and modifications, determination as to whether there is a missing tone is made on all the tone range in the density information included in input image data.

However, determination as to whether there is a missing tone may be made on part of the tone range in the density information in input image data.

This is because the density range (tone components) in an input image may be limited depending on the type of the picture, and, if the image to be printed is a photograph of a person's face, there is little color information other than information about halftone (such as the skin color).

In such a case, part of the tone range in an input image should be set as the tone range to be subjected to tone correction, or the tone range in which determination as to whether there is a missing tone is to be made.

The following is a description of a case where part of the tone range in an input image is set as the tone range for tone correction.

Control section 100 determines whether there is a missing tone component by determining whether the ratio of the frequency obtained by accumulating the frequencies of the respective tone components in part of the tone range to the total frequency obtained by accumulating the frequencies of the respective tone components in the density information included in input image data is equal to or lower than a predetermined ratio (threshold value).

Figure 8:
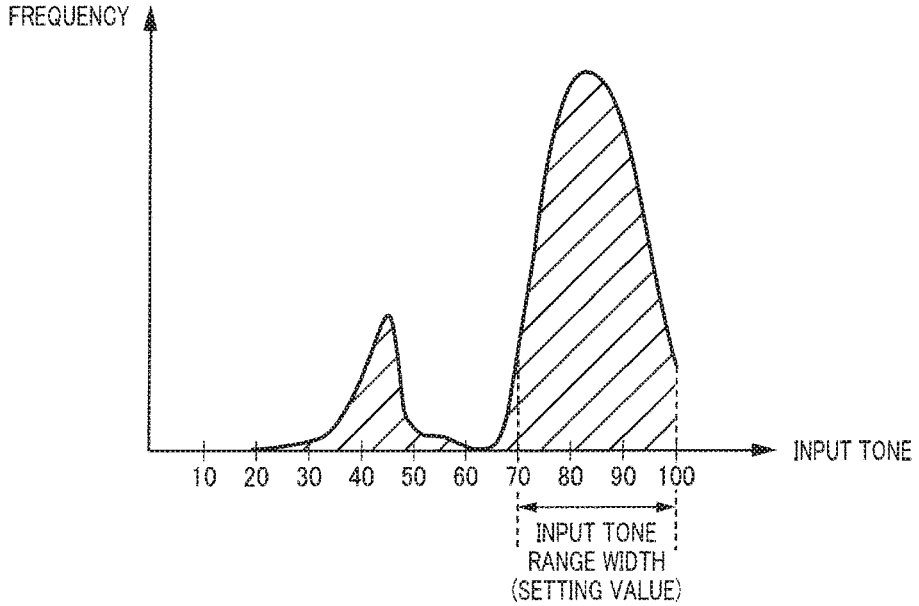
FIG. 8 is a histogram showing input tone width-frequency characteristics for explaining another example process related to tone correction.

Referring now to FIG. 8, an example of such a determination process is described. FIG. 8 is a histogram showing input tone-frequency characteristics.

In the example described below, the tone range to be subjected to tone correction is set in the range of tone values 70 to 100, and the threshold value is set at 60(%).

Control section 100 counts the number of pixels (the number of appearances) for each tone value (unit density width) in the density information included in the input image data, to calculate the number of appearances at each tone value, and calculate the appearance frequency (%) of the tone range to be subjected to tone correction.

Control section 100 then compares the calculated appearance frequency with the threshold value. If the appearance frequency of the tone range set as the range to be subjected to tone correction is equal to or lower than the threshold value, control section 100 determines that there is a missing tone, or there is a missing tone in the tone range (tone values 70 to 100 in this example) (YES in step S50 of FIG. 5). In this case, the processes in step S60 and the steps that follow in FIG. 5 (patch image formation and the like) are performed on the range of tone values 70 to 100, so that tone correction is performed on an important tone range such as the above described halftone in a photograph of a person's face.

If a result of comparison between the calculated appearance frequency and the threshold value shows that the appearance frequency of the tone range set as the object to be determined is higher the threshold value, on the other hand, control section 100 determines that there are no missing tones, or there are no missing tones in the tone range (tone values 70 to 100 in this example) (NO in step S50 of FIG. 5). In this case, control section 100 performs the tone correction in step S80, using the input-output characteristics data (see FIG. 9) corresponding to the respective tone components in the set tone range (tone values 70 to 100 in this example). However, control section 100 does not perform the tone correction on the unset tone range (tone value 0 to 69 in this example).

Through such a process, high-speed tone correction is performed on the important tone range included in the input image data.

More specifically, in the example shown in FIG. 8, control section 100 calculates the ratio between the total number of appearance frequencies in the range of tone values 70 to 100 and the total number of appearance frequencies in the range of tone values 0 to 100. By doing so, control section 100 calculates the appearance frequency or the area ratio in the range of the tone value 70 to 100.

Where the number of pieces of information (the total number of pieces of information about the respective tones) included in the input image data is 100, control section 100 calculates the ratio of the number (aggregated number) of pieces of information about the tones in the range of "70% to 100%" to the number of pieces of information about all the tones to be 70, for example. In other words, where the total area of the regions shaded over the full width of the input tones 0 to 100 in FIG. 8 is represented by 100(%), the area ratio of the shaded regions in the range of the input tones 70 to 100 is calculated to be 70 (%).

Since the calculated value of 70(%) exceeds the threshold value of 60, control section 100 determines that there are no missing tones in the tone range (tone values 70 to 100) (NO in step S50), and performs tone correction in the above described manner.

Figure 9:
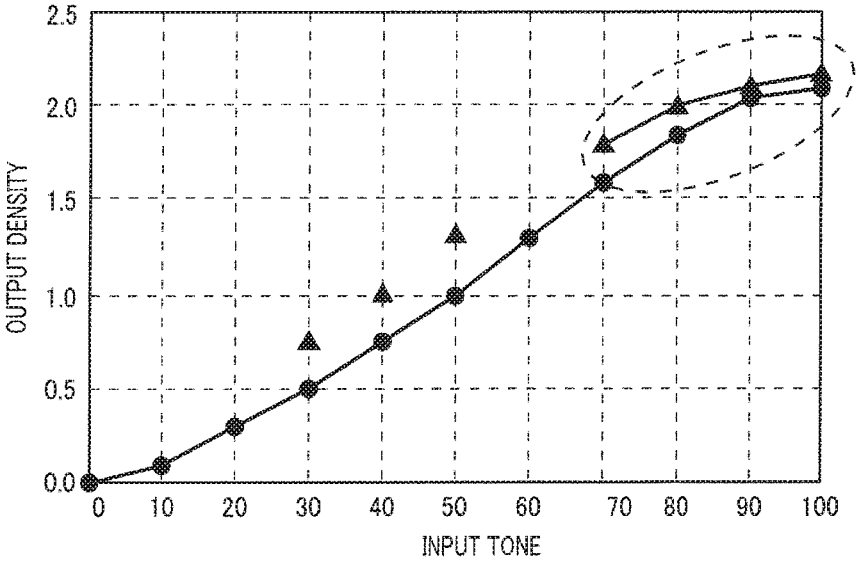
FIG. 9 is a graph for explaining a tone correction process in the example shown in FIG. 8, and shows an example of input-output characteristics data.

In this case, control section 100 does not perform the above described processes in steps S60 and S70 (correction patch creation and the like), and performs a tone correction process, using the information about the range of tone values 70 to 100 circled by a dotted line in FIG. 9 (step S80). Therefore, no tone correction is performed for the other range (the range of tone values 0 to 69 in this example).

The setting value (setting width) of the tone range to be subjected to the tone correction can be arbitrarily designated by the user, and it is also possible to designate two or more setting ranges, such as the range of tone value 30 to 60 and the range of tone values 70 to 100.

By performing the above described process, image forming apparatus 1 can perform tone correction during execution of a print job, without stopping the print job.

Also, by performing the above described process, image forming apparatus 1 can perform tone correction making full use of the actual image. Thus, image forming apparatus 1 can minimize toner consumption, and achieve high correction accuracy.

Further, image forming apparatus 1 performs tone correction by complementing the information about the actual image. Thus, image forming apparatus 1 can obtain information necessary for tone correction, without any limitation being put on the tones to be obtained.

In the above described embodiment, if it is determined in step S50 that there are no missing tones, the process moves on to step S80, and tone correction is performed. However, if it is determined in step S50 that there are no missing tones, the process may move on to step S90, and no tone correction may be performed in accordance with user settings.

In the above described embodiment, the determination as to whether there is a missing tone (step S50) and the patch image formation (step S60) are performed with the use of an image formed on a sheet after image fixing.

In a modification of this process, it is also possible to perform the determination as to whether there is a missing tone (step S50) and the patch image formation (step S60) by using an image formed on intermediate transfer belt 421 after the image transfer. In this case, density detecting sensor 80 is disposed in a predetermined region on intermediate transfer belt 421, or in a region on the downstream side of the transfer section and on the upstream side of fixing section 60.

As described above, image forming apparatus 1 of Embodiment 1 can perform tone correction with high accuracy, while reducing toner consumption and preventing a decrease in productivity.

In the above described embodiment, control section 100 is designed to serve as the tone correcting section, the determining section, and the complementing section. In another example, a special-purpose processor may have some or all of the functions of the tone correcting section, the determining section, and the complementing section. Here, the special-purpose processor includes not only the internal processor of image forming apparatus 1 but also a processor of an external apparatus capable of communicating with image forming apparatus 1.

Embodiment 2

Referring now to FIGS. 10 through 19, Embodiment 2 of an image forming apparatus is described. The same sections as those of Embodiment 1 are denoted by the same reference numerals as those used in Embodiment 1, and explanation thereof will not be repeated below as appropriate.

Figure 10:
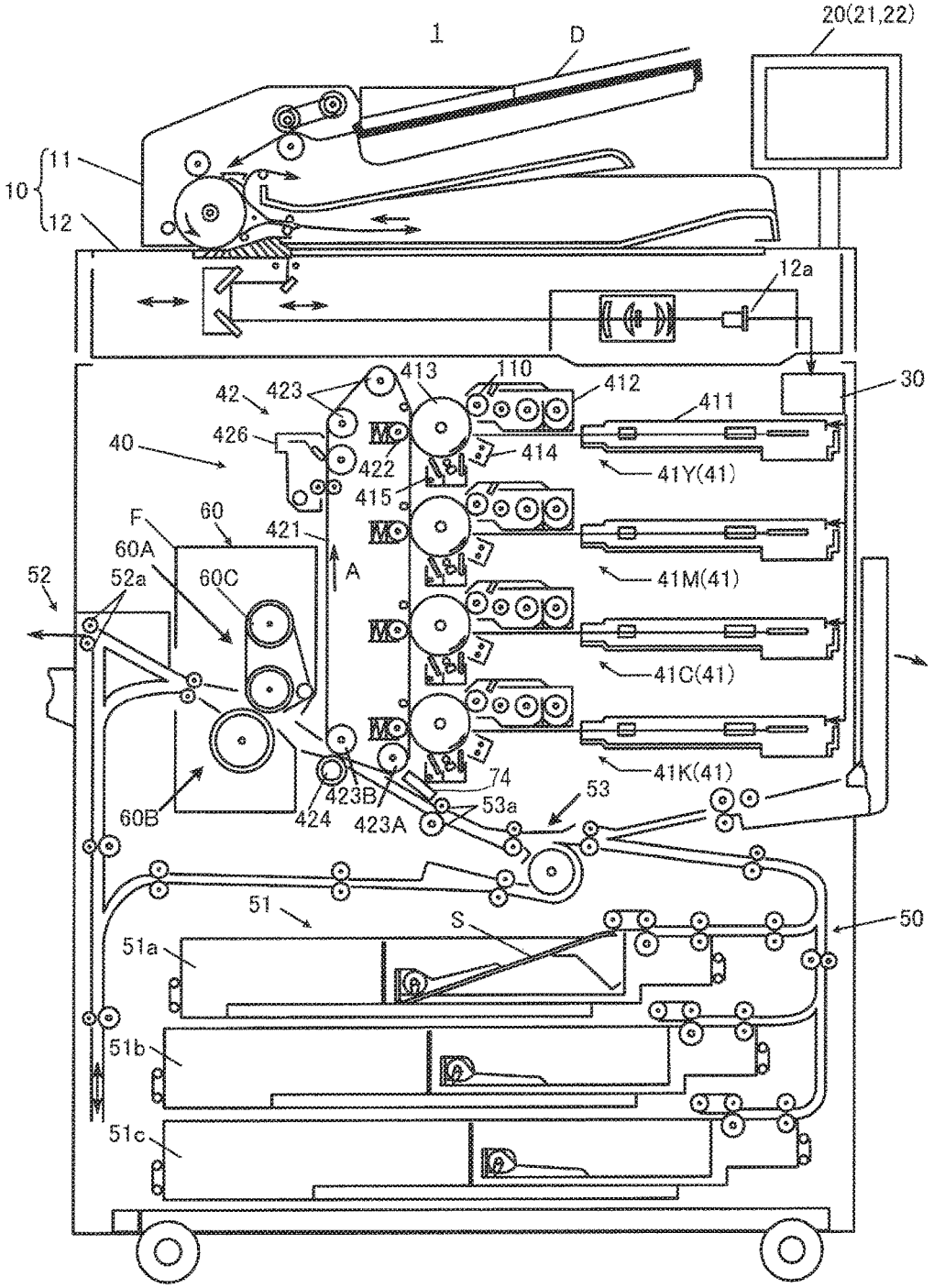
FIG. 10 is a diagram schematically showing the structure of an entire image forming apparatus according to Embodiment 2.
Figure 11:
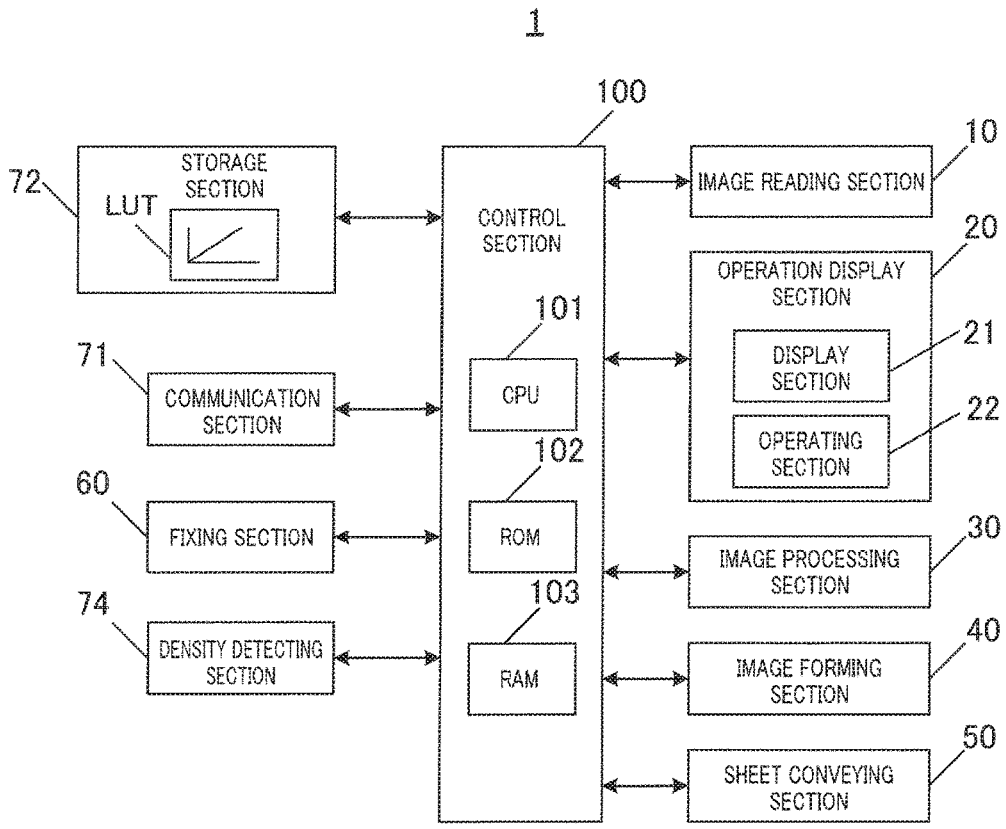
FIG. 11 is a diagram showing the principal components of a control system of the image forming apparatus according to Embodiment 2.

FIG. 10 schematically shows the structure of an entire image forming apparatus 1 according to Embodiment 2. FIG. 11 shows the principal components of the control system of the image forming apparatus 1 according to Embodiment 2. As can be seen from a comparison with FIG. 1, in the image forming apparatus according to Embodiment 2, density detecting sensor 80 on the downstream side of fixing section 60 is replaced with density detecting section 74 disposed in the vicinity of intermediate transfer belt 421.

Density detecting section 74 detects color information (including color elements and density) in the output image transferred onto intermediate transfer belt 421, and outputs a detection value to control section 100. An image density control (IDC) sensor, a charge coupled device (CCD) sensor, or the like is used as density detecting section 74.

Alternatively, density detecting section 74 may be positioned to detect color information about an output image output onto an image bearing member such as photoconductor drum 413 or sheet S.

In Embodiment 2, image processing section 30 and control section 100 function as a density correcting section.

The density correcting section performs density correction in accordance with a detection value of the density of a first output image. In a case where input image data (equivalent to the "first image data" of the present invention) does not include the color information corresponding to tone data, the density correcting section calculates a detection value of the density of a second output image in accordance with the detection value of the density of the first output image, on the assumption that the second output image has been formed by image forming section 40 in accordance with second image data including the color information. The density correcting section then performs density correction, using the calculated estimate value. In the description below, the density correcting section calculates an estimate value of the density of the second output image, every time a detection value of the density of the first output image detected by density detecting section 74 is output to control section 100 (or for each output image).

In the description below, the term "detection value" means a detection value of the density of an image in a secondary color or a color on a higher order in an output image, a detection value of the density of an image in a primary color forming a secondary image or an image on a higher order, or an estimate value calculated in advance. Further, a "detection value" and an "estimate value" may represent tones in chromatic coordinates in some cases. It should be noted that an image in a primary color is referred to as a monochrome image, and an image in a secondary color or a color on a higher order is referred to as a multicolor image in some cases.

The density correcting section calculates a designated tone (an estimate value) in accordance with tones as detection values in chromatic coordinates, and corrects the initial value or the like (described later) in tone data (the 3D-LUT described later, for example) at the calculated designated tone. Here, the tones in chromatic coordinates include the tone of a multicolor image, and the tones of the monochrome images constituting the tone of the multicolor image. The tones in chromatic coordinates as detection values and the designated tone calculated in accordance with the tones in chromatic coordinates are already calculated data in the tone data. Here, image densities are represented by tones 0 to 255. Further, the minimum tone 0 is represented by tone 0%, and the maximum tone 255 is represented by tone 100%, for example. Meanwhile, the designated tone is a tone between tone 80% and tone 100%. The designated tone is not limited to this, and may be a tone between tone 45% and tone 55%. In the description below, correction of tone data is sometimes referred to as density correction. It should be noted that density correction is not limited to correction of tone data, but includes generation of a so-called gamma correction curve and feedback to image formation conditions such as the charging potential, the developing potential, and the exposure amount, and correction of the image formation conditions. The generation of a gamma correction curve and the correction of the image formation conditions correspond to the "correction of the printing condition" of the present invention.

Figure 12:
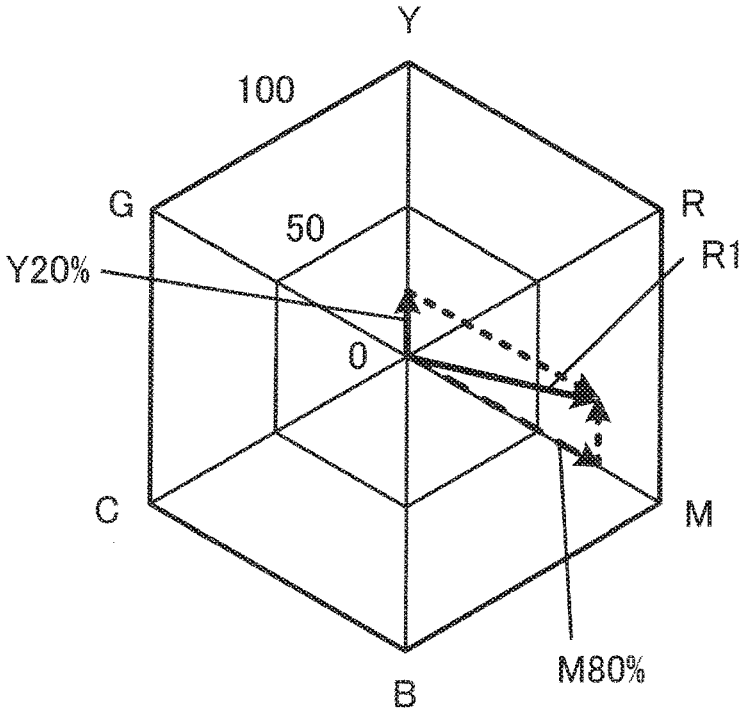
FIG. 12 is a diagram showing the tone of a multicolor image and the tones of monochrome images plotted in chromatic coordinates.
Figure 13:
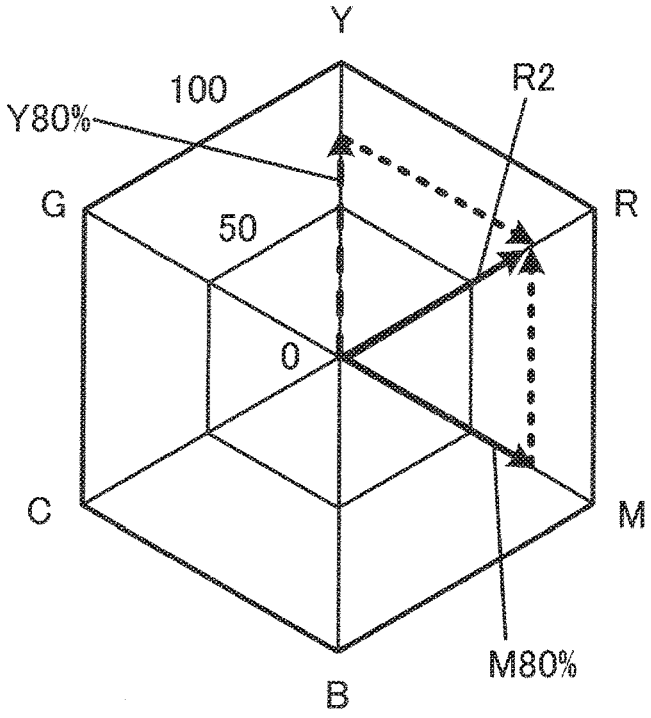
FIG. 13 is a diagram showing the tone of a multicolor image and the tones of monochrome images plotted in chromatic coordinates.

Referring now to FIGS. 12 and 13, the density correcting section is described in detail.

FIGS. 12 and 13 are diagrams showing the tone of a multicolor image and the tones of monochrome images plotted in chromatic coordinates. FIGS. 12 and 13 show yellow (Y), magenta (M), and cyan (C), which are primary colors, and red (R), green (G), and blue (B), which are secondary colors. FIGS. 12 and 13 also show tone 100% as the maximum tone, and tone 0% as the minimum tone. Further, FIG. 12 shows tone R1 of the multicolor image, tone Y 20% of a monochrome image (yellow), and designated tone M 80% of a monochrome image (magenta).

The density correcting section determines color information (color information about the second image data) not included in the input image data, in accordance with the object to be subjected to the density correction. The density correcting section selects a tone in chromatic coordinates in accordance with the color information, and calculates the designated tone in accordance with the selected tone in chromatic coordinates. Here, the designated tone is tone 80% of the monochrome image (magenta). The tones in chromatic coordinates are tone R1 of the multicolor image and tone Y 20% of the monochrome image (yellow).

In accordance with tone R1 of the multicolor image and tone Y 20% of the monochrome image (yellow), the density correcting section calculates designated tone M 80% of the monochrome image (magenta), according to the equations 1 and 2 shown below.

[1]

$$\overrightarrow{R1}=\overrightarrow{Y20\%}+\overrightarrow{M80\%} \quad (1)$$

$$\overrightarrow{M80\%}=\overrightarrow{R1}-\overrightarrow{Y20\%} \quad (2)$$

$$\overrightarrow{M80\%}=\overrightarrow{R1}-f*\overrightarrow{Y18\%} \quad (3)$$

In a case where tone Y 20% of the monochrome image (yellow) does not exist, the density correcting section calculates designated tone M 80% of the monochrome image (magenta) according to equation 3, in accordance with a tone close to tone Y 20% of the monochrome image (yellow), such as tone Y 18% of the monochrome image (yellow). It should be noted that "f" shown in equation 3 represents a function to be used in a case where a designated tone is determined from a close tone.

Further, in the above vector operation, an operation using a correction term may be performed to increase operational precision. In particular, a high degree of correction may be performed on dark tones and yellow (Y), which is an upstream color, with back transfer being taken into consideration.

An operation using a correction term (0.9, for example) is shown in equation 1' shown below.

[2]

$$\overrightarrow{R1}=\overrightarrow{Y20\%}+0.9*\overrightarrow{M80\%} \quad (1')$$

The density correcting section calculates the designated tone of the multicolor image, in accordance with the tones of the monochrome images constituting the multicolor image. The density correcting section also calculates new designated coordinates in accordance with a designated tone that has been calculated in advance.

FIG. 13 shows multicolor image R2, tone M 80% of a monochrome image (magenta) as a designated tone calculated in advance, and tone Y 80% of a monochrome image (yellow) as the designated tone to be calculated.

In this case, the density correcting section also determines color information not included in the input image data in accordance with the object to be subjected to the density correction, and selects the tones in chromatic coordinates for calculating the designated tone. Here, the designated tone is tone Y 80% of the monochrome image (yellow). The tones in chromatic coordinates for calculating the designated tone is tone R2 of the multicolor image and tone M 80% of the monochrome image (magenta).

In accordance with tone R2 of the multicolor image and tone M 80% of the monochrome image (magenta), the density correcting section calculates designated tone Y 80% of the monochrome image (yellow), according to equations 4 and 5 shown below.

[3]

$$\overrightarrow{R2}=\overrightarrow{Y80\%}+\overrightarrow{M80\%} \quad (4)$$

$$\overrightarrow{Y80\%}=\overrightarrow{R2}-\overrightarrow{M80\%} \quad (5)$$

The density correcting section performs density correction in accordance with the calculated designated tone Y 80% of the monochrome image (yellow).

(Correction of Tone Data)

FIG. 14 is a diagram showing a 3D-LUT (three-dimensional lookup table) as tone data. Specifically, the density correcting section corrects the data in the 3D-LUT. In the 3D-LUT shown in FIG. 14, the required number of pieces of data is the data of ten tones from tone 10% to tone 100% for the four colors of R, G, B and Gray (grayscale), or a total of 40 pieces of data.

An initial value or a numerical value (an initial value or the like) at the time of the previous density correction is input to the 3D-LUT and is stored therein. In the correction of the tone data, if tone R 80% of a red (R) image that is a multicolor image is formed with tone Y 80% of a monochrome image (yellow) and tone M 80% of a monochrome image (magenta), the density correcting section performs correction to change tone Y 80%, which is the initial value or the like, to designated tone Y 80%.

To stabilize the densities of output images, it is preferable to change the initial value or the like to the designated tone in real time. The density correcting section can arbitrarily set the tone interval. Although the density correction accuracy can be increased in accordance with the length of the tone interval, the required number of pieces of data as the 3D-LUT becomes larger, and the time required for data collection becomes longer accordingly. Therefore, it is difficult to change the initial value or the like to the designated tone in real time. This might hinder image density stabilization. In view of this, the density correcting section sets the tone interval in accordance with the system.

(Correction of Image Formation Conditions)

The density correcting section performs density correction in accordance with a designated tone of a monochrome image. For example, in a case where the designated tone is solid (tone 80% to tone 100%, for example), the density correcting section corrects the developing voltage. In a case where the designated tone is halftone (tone 45% to tone 55%, for example) or highlight (tone 0% to tone 10%), the density correcting section corrects the exposure amount.

The density correcting section sets the reliability of the tones in chromatic coordinates as the detection values of the densities of output images at "10". The density correcting section sets the reliability of a tone in chromatic coordinates as a calculated estimate value at the numerical value obtained by subtracting "2" from the lower one of the reliabilities of the tones in chromatic coordinates used in calculating the estimate value. In a case where the tones in chromatic coordinates include a solid tone, the reliability is set at the numerical value obtained by subtracting "5" from the reliability of the solid tone. The reason that "5" is subtracted is to set a low reliability for the tones in chromatic coordinates including the solid tone, since a high density is detected from the uppermost color in a multicolor image that is a secondary image or an image on a higher order.

The density correcting section performs density correction in accordance with the reliability of the tone in chromatic coordinates as a calculated estimate value. The reason that density correction is performed in accordance with the reliability of the tone is that density correction based on a tone with a higher reliability can stabilize the densities of output images, and increase density correction accuracy with a higher degree of certainty.

TABLE 1

| Reliability | Feedback amount |
|---|---|
| 9, 10 | 80% |
| 5 to 8 | 40% |
| 1 to 5 | 10% |

Table 1 is a table showing the relationship between reliability and feedback amount. For example, in a case where the reliability is "9", the density correcting section corrects the image formation conditions by setting the feedback amount at 80%. In a case where the designated tone is solid, the density correcting section corrects the developing potential, the rotational speed of the developing sleeve, and the exposure amount (lighting time), for example. In a case where the designated tone is halftone or highlight, for example, the density correcting section corrects the exposure amount and the fogging voltage (a difference between the grid voltage and the developing potential), for example.

Referring now to FIGS. 15 through 17, a specific example of the density correcting section is described.

In this specific example, a density correcting section that calculates a designated tone of a monochrome image is described. The density correcting section preferentially calculates a solid tone as the designated tone of the monochrome image, and performs density correction in accordance with the calculated designated tone. The reason for calculating the designated tone of the monochrome image is that a tone of a secondary color is affected by the tones of the primary colors constituting the secondary color.

Specifically, the density correcting section corrects the data in the 3D-LUT. The data that needs to be obtained as the 3D-LUT is the data of ten tones from tone 10% to tone 100% in each of the colors of R, G, B, and Gray (grayscale), or 40 pieces of data from R 10% (Y 10%, M 10%) to Gray 100% (Y 100%, M 100%, C 100%).

In the description below, highlight (any tone from tone 0% to tone 10%), halftone (any tone from tone 45% to tone 55%), and solid (any tone from tone 80% to tone 100%) are described as examples of designated tones of monochrome images to be calculated, for ease of explanation.

FIG. 15 is a table showing entry fields divided by primary colors of yellow (Y), magenta (M), cyan (C), and black (K), and tones (highlight, halftone, and solid) of each of the colors. In FIG. 15, each entry field where the same color and the same tone intersect indicates the tone of a monochrome image, and each entry field where different colors intersect indicates the tone of a multicolor image. Also, because there is no difference between the rows and the columns, the presence or absence of data in each entry field remains the same even if the rows and the columns are switched.

Each letter "A" shown in some of the entry fields in FIG. 15 indicates the tone of a monochrome image or a multicolor image that can be detected directly by density detecting section 74.

TABLE 2

| Y | | | M | | | C | | | K | | |
|---|---|---|---|---|---|---|---|---|---|---|---|
| Highlight | Halftone | Solid | Highlight | Halftone | Solid | Highlight | Halftone | Solid | Highlight | Halftone | Solid |
| | A | | A | | A | | A | | | A | A |

Each letter "A" shown in some of the entry fields in Table 2 indicates the tone of a monochrome image that is detected directly by density detecting section 74. The reliability of the tone of each monochrome image that is directly detected is set at "10". In this description, density correcting section 74 calculates the tones of monochrome images in the entry fields (spaces) not accompanied by any character.

(Example of a Designated Tone: Y Solid)

In the description below, the tone of a monochrome image is represented as (Y solid) using a primary color or the tone of the primary color, for example. Meanwhile, the tone of a multicolor image is represented as (Y solid, M solid) using primary colors and the tones of the respective primary colors, for example.

In accordance with the tone (Y solid, M solid) of the multicolor image and the tone (M solid) of one of the monochrome images constituting the multi-color image, the density correcting section calculates the designated tone (Y solid) of the monochrome image according to equation 6 shown below. It should be noted that the reliability of the calculated tone of a monochrome image is set at the value obtained by subtracting "2" from the one having the lower reliability of the tones in chromatic coordinates.

$$\text{Chromatic coordinates } (Y \text{ solid, no } M, \text{ no } C, \text{ no } K) = g\,(\text{chromatic coordinates } (Y \text{ solid}, M \text{ solid, no } C, \text{ no } K) - \text{chromatic coordinates } (\text{no } Y, M \text{ solid, no } C, \text{ no } K) \quad (6)$$

Here, g represents a function for correcting an electrophotographic transfer rate, and is defined as described below, for example. Further, "no" as in the above "no Y, "no M", "no C", and "no K" represents that there is not a tone of each color in chromatic coordinates.

To increase density correction accuracy, the density correcting section determines whether a tone in chromatic coordinates is solid in the order of black (K), cyan (C), magenta (M), and yellow (Y), and adds a constant set for each color to the color determined first to be solid. For example, when determining that C is solid, the density correcting section adds coordinates (−3, −2, −3) in the (L*a*b*) color space as the constant for C. It should be noted that the density correcting section does not add any constant if any of the colors of K, C, M and Y is not solid.

(Example of a Designated Tone: M Halftone)

FIG. 16 is a table showing a designated tone of a monochrome image calculated from the tones of multicolor images and the tones of monochrome images.

In accordance with the tone (Y halftone, M halftone) of a multicolor image, the tone (Y halftone) of a monochrome image, the tone (M halftone, C halftone) of a multicolor image, and the tone (C halftone) of a monochrome image, the density correcting section calculates the designated tone (M halftone) of a monochrome image according to equation 7 shown below. Since the calculated tones of the monochrome images are values calculated from secondary colors, the reliabilities of these calculated tones are regarded high, and are set at the values obtained by subtracting "1" from the ones having the lower reliabilities of the tones in chromatic coordinates.

$$\text{Chromatic coordinates } (\text{no } Y, M \text{ halftone, no } C, \text{ no } K) = \tfrac{1}{2} \times [\{g\,(\text{chromatic coordinates } (Y \text{ halftone}, M \text{ halftone, no } C, \text{ no } K) - \text{chromatic coordinates } (Y \text{ halftone, no } M, \text{ no } C, \text{ no } K)\} + \{g(\text{chromatic coordinates } (\text{no } Y, M \text{ halftone}, C \text{ halftone, no } K) - \text{chromatic coordinates } (\text{no } Y, \text{ no } M, C \text{ halftone, no } K)\}] \quad (7)$$

In FIG. 16, a dashed arrow indicates the direction from the tone (Y solid, M solid) of a multicolor image toward the density information as a designated tone (Y solid) in a case where the designated tone (Y solid) is calculated. Further, in FIG. 16, dashed arrows indicate the direction from the tone (Y halftone, M halftone) of a multicolor image toward the density information as the designated tone (M halftone), and the direction from the tone (M halftone, C halftone) toward the density information as the designated tone (M halftone), in a case where the designated tone (M halftone) is calculated.

TABLE 3

| Y | | | M | | | C | | | K | | |
|---|---|---|---|---|---|---|---|---|---|---|---|
| Highlight | Halftone | Solid | Highlight | Halftone | Solid | Highlight | Halftone | Solid | Highlight | Halftone | Solid |
| A | A | A | A | A | A | | A | A | | A | A |

Each letter "A" newly added in entry fields in Table 3 indicates the calculated tone of a monochrome image.

(Example of a Designated Tone: C Highlight)

FIG. 17 is a table showing a designated tone of a monochrome image calculated from the tone of a multicolor image and the pre-calculated tone of a monochrome image.

In accordance with the tone (Y highlight, C highlight) of a multicolor image and the pre-calculated tone (Y highlight) of a monochrome image, the density correcting section calculates the designated tone (C highlight) of a monochrome image according to equation 8 shown below. It should be noted that the reliability of the calculated C highlight is "6", which is the value obtained by subtracting "2" from the reliability "8" of the tone (Y highlight, C highlight) of the multicolor image, for example.

Chromatic coordinates (no *Y*, no *M*, *C* highlight, no *K*)=*g* (chromatic coordinates (*Y* highlight, no *M*, *C* highlight, no *K*)−chromatic coordinates (*Y* highlight, no *M*, no *C*, no *K*) (8)

In FIG. 17, a dashed arrow indicates the direction from the tone (Y highlight, C highlight) of the multicolor image toward the density information about the designated tone (C highlight) in a case where the designated tone (C highlight) is calculated.

TABLE 4

| Y | | | M | | | C | | | K | | |
|---|---|---|---|---|---|---|---|---|---|---|---|
| Highlight | Halftone | Solid | Highlight | Halftone | Solid | Highlight | Halftone | Solid | Highlight | Halftone | Solid |
| A | A | A | A | A | A | A | A | A | A | A | A |

Each letter "A" newly added in Table 4 indicates the calculated tone of the monochrome image.

Figure 18:
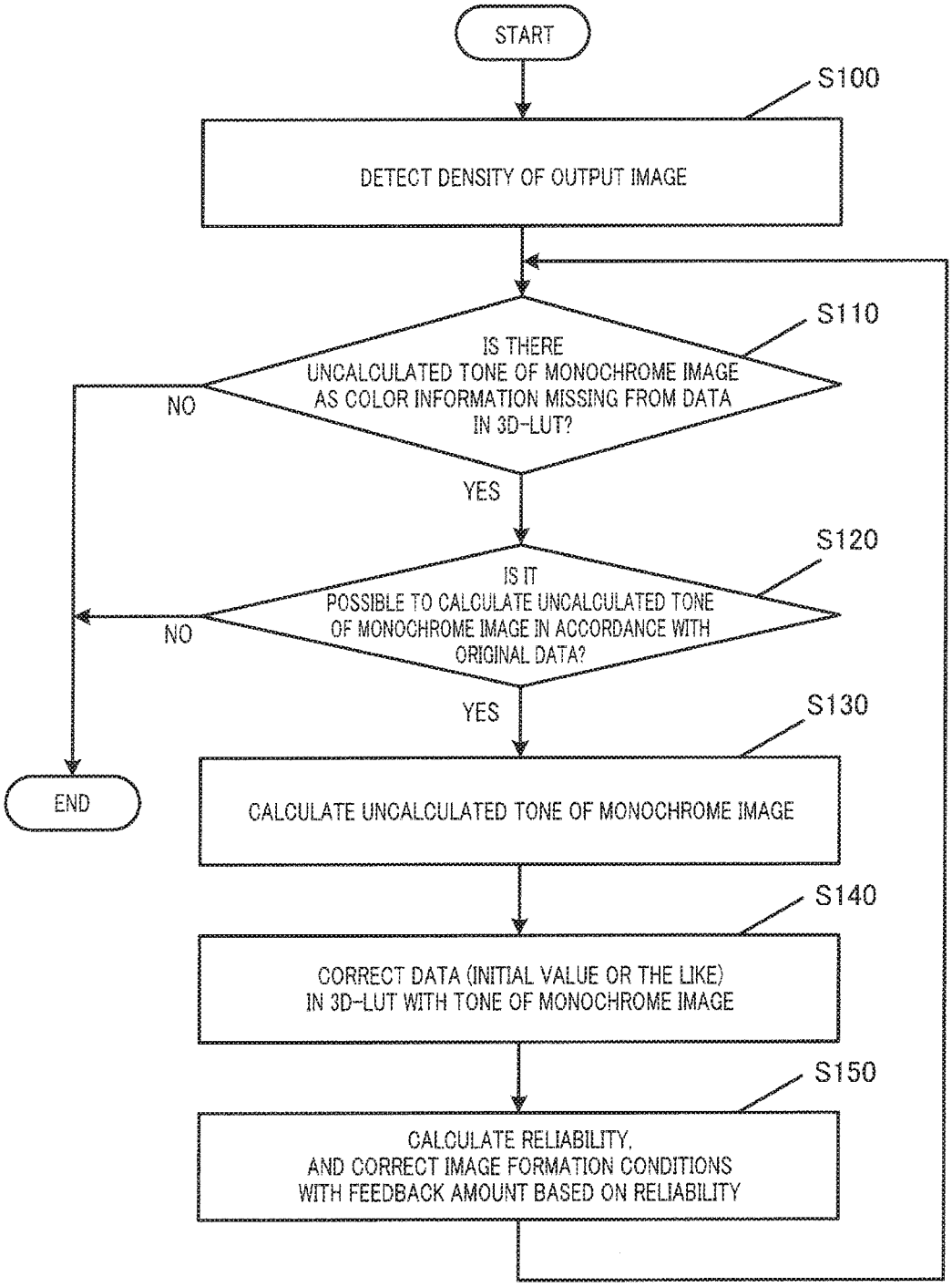
FIG. 18 is a flowchart showing an example of an image density correction process.

Referring now to FIG. 18, an example of a density correction process is described. FIG. 18 is a flowchart showing an example of a density correction process. This process is started when image forming apparatus 1 receives a print job, and is performed as CPU 101 executes a predetermined program stored in ROM 102.

In step S100, density detecting section 74 detects the density of an output image. Density detecting section 74 outputs the detection value to control section 100.

In step S110, the density correcting section determines whether the data in the 3D-LUT includes the tone of a monochrome image that has not been calculated yet (a tone with the initial value or the like) as color information not included in the input image data.

If the density correcting section determines that the data in the 3D-LUT does not include the tone of a monochrome image that has not been calculated yet (NO in step S110), the density correcting section ends this process.

If the density correcting section determines that that the data in the 3D-LUT includes the tone of a monochrome image has not been calculated yet (YES step S110), on the other hand, the density correcting section determines whether the tone of the monochrome image that has not been calculated yet can be calculated in accordance with tones in chromatic coordinates (the tone of a multicolor image in an output image, the tone of a monochrome image, and the tone of a monochrome image that has been calculated in advance) (step S120).

If the density correcting section determines that the tone of the monochrome image that has not been calculated yet cannot be calculated (NO in step S120), the density correcting section ends this process.

If the density correcting section determines that that the tone of the monochrome image that has not been calculated yet can be calculated (YES in step S120), on the other hand, the density correcting section calculates the tone of the monochrome image in accordance with tones in chromatic coordinates (step S130).

In step S140, the density correcting section corrects the data (the initial value or the like) in the 3D-LUT with the calculated tone of the monochrome image.

In step S150, the density correcting section calculates the reliability of the calculated tone of the monochrome image, and corrects the image formation conditions with the feedback amount (see Table 1) based on the calculated reliability. After that, the density correcting section returns this process to step S110.

In the above described embodiment, the density correcting section calculates an estimate value for each output image. However, the present invention is not limited to this, and an estimate value may be calculated for every predetermined number (five, for example) of output images. Depending on the detection value of the density of one output image, the required number of pieces of data might not be prepared in the 3D-LUT. Data in the 3D-LUT can be corrected only after the required number of pieces of data are prepared with the detection values of the densities of a predetermined number of output images. Also, the density correcting section may store the detection values of the densities of the latest output images (the latest ten output images, for example) into storage section 72, and calculate an estimate value in accordance with the detection values of the latest output images. With this, the responsiveness of density correction and the correction accuracy can be increased.

Also, in the above described embodiment, a designated tone is calculated with the use of the L*a*b* coordinate system. However, the present invention is not limited to this, and it is possible to calculate a designated tone in a coordinate system such as an RGB system or an xyz coordinate system, using an appropriate arithmetic function.

In the image forming apparatus of the above described embodiment, density detecting section 74 detects the density of a first output image that is output in accordance with the tone data corresponding to the color information about input image data. In a case where input image data does not include the color information corresponding to tone data, the density correcting section calculates a detection value of the density of a second output image in accordance with the detection value of the density of the first output image, on the assumption that the second output image has been formed in accordance with second image data including the color information. The density correcting section then performs density correction, using the calculated estimate value. This eliminates the need to create a patch image for density correction, prevents a decrease in productivity, and also prevents an increase in toner consumption.

In a case where the density correcting section calculates an estimate value in accordance with a detection value, the previously calculated estimate value is used as the detection value. Accordingly, where the number of estimate values as detection values is increased, an estimate value can be efficiently calculated.

Further, the density of an output image that is output onto the intermediate transfer belt is detected, and density correction is performed in accordance with the detected detection value. With this, the responsiveness of density correction can be made higher than that in a case where density correction is performed in accordance with the detection value of the density of an output image that is output onto sheet S or the like.

Modification 1

In the above described embodiment, a secondary color image is used as a multicolor image, and the density correcting section calculates the tone of a monochrome image in accordance with the tone of the secondary color image.

In Modification 1, on the other hand, a tertiary color image in which the three colors of yellow (Y), magenta (M), and cyan (C) are mixed is used as a multicolor image, and the density correcting section calculates the tone of a secondary color image in accordance with the tone of the tertiary color image.

Figure 19:
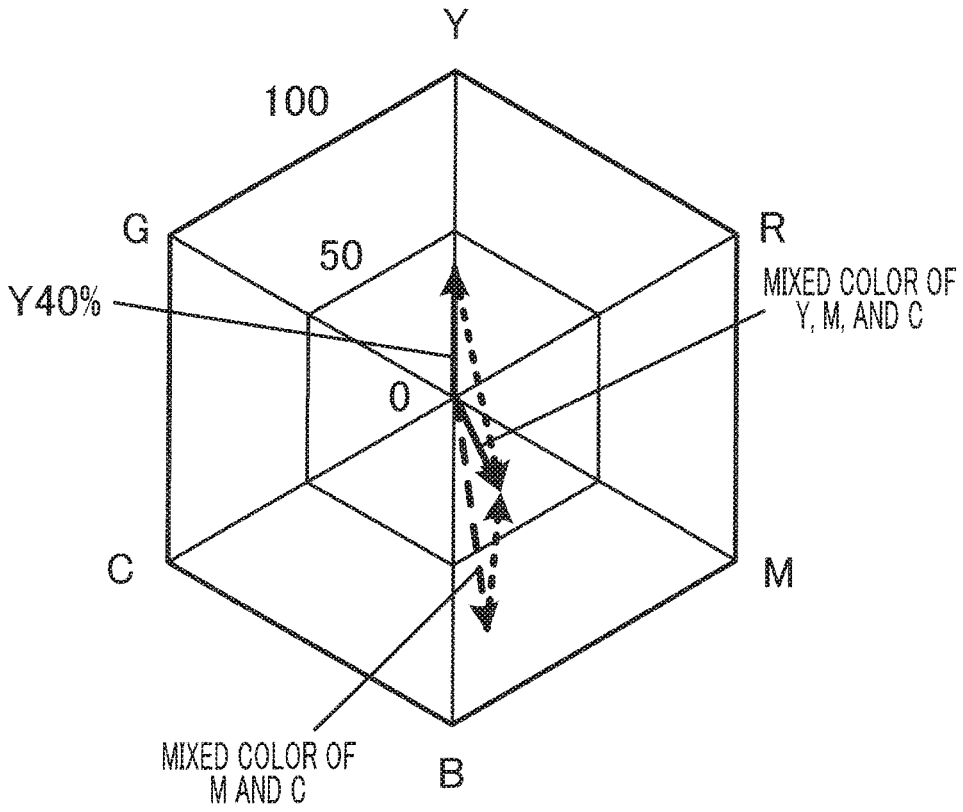
FIG. 19 is a diagram showing the tone of a tertiary color image and the tone of a monochrome image plotted in chromatic coordinates.

FIG. 19 is a diagram showing the tone of a multicolor image and the tone of a monochrome image plotted in chromatic coordinates. As shown in FIG. 19, the density correcting section calculates the tone of a secondary color image in M and C from the tone of a tertiary color image in Y, M and C and the tone of a monochrome image in Y. For example, the density correcting section corrects the data of B 80% (C 80%, M 80%) in a 3D-LUT with the calculated tone (C 80%, M 80%) of the secondary color image in M and C.

According to Modification 1, it is possible to correct data (a tone of C and a tone of M, for example) in a 3D-LUT at once.

Modification 2

In the above described embodiment, the tone of one of the primary colors constituting a secondary color is calculated in accordance with the tone of the secondary color and the tone of the other one of the primary colors constituting the secondary color.

In Modification 2, on the other hand, the density correcting section calculates the tone of a multicolor image obtained by combining monochrome images having the same tone. For example, the density correcting section calculates tone Gray 80% of Gray (grayscale) from a tone 80% of Y, a tone 80% of M and a tone 80% of C. With this, the tone of a multicolor image that is not included in input image data can be efficiently calculated.

The density correcting section also calculates the tone of a secondary color in accordance with the tones of the primary colors constituting the secondary color, for example, and performs density correction in accordance with the calculated tone. For example, the density correcting section calculates the tone of red (R) in accordance with the tones of yellow (Y) and magenta (M), which constitute R, and performs density correction in accordance with the calculated tone. The density correcting section also calculates the tone of green (G) in accordance with the tones of Y and cyan (C), which constitute G, and performs density correction in accordance with the calculated tone. The density correcting section also calculates the tone of blue (B) in accordance with the tones of M and C, which constitute B, and performs density correction in accordance with the calculated numerical value. According to Modification 2, the tone of a multicolor image that is not included in input image data can be efficiently calculated.

As described above, with image forming apparatus 1 of Embodiment 2, a decrease in productivity can be prevented, and an increase in toner consumption can also be prevented.

The present invention can be applied to an image forming system formed with units including an image forming apparatus. The units include a post-processing apparatus and an external apparatus such as a control apparatus connected to the network, for example.

Although embodiments of the present invention have been described and illustrated in detail, it is clearly understood that the same is by way of illustration and example only and not limitation, the scope of the present invention should be interpreted by terms of the appended claims.

What is claimed is:

1. An image forming system including a plurality of units, the units including an image forming apparatus having an image forming section that forms a toner image on an image bearing member in accordance with input image data, the image forming system comprising:

a density detecting section configured to detect a density of the toner image formed on the image bearing member by the image forming section, the density being detected as an output image density;

a hardware processor which performs;

tone correction in accordance with input-output characteristics data indicating a relationship between an input image density and an output image density, the input image density being an image density of a tone component included in the input image data, the output image density being detected by the density detecting section in accordance with the tone component;

determining whether there is a missing tone component in the input image data; and complementing the input-output characteristics data corresponding to the missing tone component, when it is determined that there is the missing tone component.

2. The image forming system according to claim 1, wherein the hardware processor performs the tone correction, using the input-output characteristics data complemented by a complementing section.

3. The image forming system according to claim 1, wherein, for an entire tone range that can be formed by the image forming section, the hardware processor determines whether there is a missing tone component.

4. The image forming system according to claim 1, wherein, for part of a tone range that can be formed by the image forming section, the hardware processor determines whether there is a missing tone component.

5. The image forming system according to claim 4, wherein the hardware processor determines whether there is a missing tone component by determining whether a ratio of a frequency obtained by accumulating frequencies of respective tone components in the part of the tone range to a total frequency obtained by accumulating frequencies of respective tone components included in the input image data is equal to or lower than a predetermined ratio, and, when it is determined that there are no missing tone components, the hardware processor performs the tone correction, using the input-output characteristics data corresponding to the respective tone components in the part of the tone range.

6. The image forming system according to claim 1, wherein the hardware processor controls the image forming section to form a patch image on the image bearing member, the patch image having an input image density, the input image density being an image density of the missing tone component, the density detecting section detects a density of the patch image formed on the image bearing member, the density of the patch image being detected as an output image density, and the hardware processor complements the input-output characteristics data corresponding to the missing tone component, using the input image density of the patch image and the output image density detected by the density detecting section.

7. The image forming system according to claim 6, wherein the hardware processor determines whether there is a missing tone component by determining whether the number of tones in a toner image density detected by the density detecting section at a predetermined timing is equal to or smaller than a predetermined number of tones.

8. The image forming system according to claim 1, wherein the hardware processor complements the input-output characteristics data corresponding to the missing tone component, the input-output characteristics data being of input-output characteristics data used for tone correction in the past.

9. The image forming system according to claim 1, wherein the image forming apparatus includes a communication device configured to communicate with one of a computer and another image forming apparatus via a network, and the hardware processor complements the input-output characteristics data corresponding to the missing tone component, the input-output characteristics data being of input-output characteristics data stored in the one of the computer and the another image forming apparatus via the network.

10. The image forming system according to claim 1, wherein the hardware processor determines whether there is a missing tone component by determining whether an input image tone coverage ratio is equal to or lower than a predetermined coverage ratio, the input image tone coverage ratio being a ratio of the total number of tones represented by the input image data to the total number of tones in a toner image that can be formed by the image forming section.

11. The image forming system according to claim 10, wherein, when it is determined that there is a missing tone component, the hardware processor controls the image forming section to form a patch image having an input image density so that one of the predetermined coverage ratio and a predetermined number of tones is exceeded, the input image density being an image density of the missing tone component, the density detecting section detects a density of the patch image formed by the image forming section, the density being detected as an output image density, and the hardware processor complements the input-output characteristics data, using the input image density of the patch image and the output image density detected by the density detecting section.

12. The image forming system according to claim 10, wherein the hardware processor determines whether there is a missing tone component by determining whether a difference in density between adjacent output image densities in an output image density of a toner image formed on the image bearing member by the image forming section in accordance with the input image data is equal to or larger than a predetermined value, the output image density being detected by the density detecting section, when it is determined that there is a missing tone component, the hardware processor controls the image forming section to form a patch image having an input image density so that the difference becomes smaller than the predetermined value, the input image density being an image density of the missing tone component, the density detecting section detects a density of the patch image formed by the image forming section, the density being detected as an output image density, and the hardware processor complements the input-output characteristics data, using the input image density of the patch image and the output image density detected by the density detecting section.

13. The image forming system according to claim 1, wherein the image bearing member is a sheet, the image forming system further comprises a fixing section configured to fix a toner image formed on the sheet by the image forming section, and the density detecting section is disposed on a downstream side of the fixing section in a direction of conveyance of the sheet.

14. The image forming system according to claim 1, wherein, when it is determined that there are no missing tone components, the hardware processor does not perform the tone correction.

15. An image forming apparatus comprising:

an image forming section configured to form a toner image on an image bearing member in accordance with input image data;

a density detecting section configured to detect a density of the toner image formed on the image bearing member by the image forming section, the density being detected as an output image density;

a hardware processor which performs;

tone correction in accordance with input-output characteristics data indicating a relationship between an input image density and an output image density, the input image density being an image density of a tone component included in the input image data, the output image density being detected by the density detecting section in accordance with the tone component;

determining whether there is a missing tone component in the input image data; and complementing the input-output characteristics data corresponding to the missing tone component, when it is determined that there is the missing tone component.

16. A tone correction method comprising:

forming a toner image on an image bearing member in accordance with input image data;

detecting a density of the toner image formed on the image bearing member;

performing tone correction in accordance with input-output characteristics data indicating a relationship between an input image density and an output image density, the input image density being represented by the input image data, the output image density being represented by a result of detection of the density of the toner image;

determining whether there is a missing tone component in the input image data; and complementing the input-output characteristics data corresponding to the missing tone component, when it is determined that there is the missing tone component.

17. A non-transitory recording medium storing a computer readable tone correction program for causing a computer to perform:

a process of forming a toner image on an image bearing member in accordance with input image data;

a process of detecting a density of the toner image formed on the image bearing member;

a process of performing tone correction in accordance with input-output characteristics data indicating a relationship between an input image density and an output image density, the input image density being represented by the input image data, the output image density being represented by a result of detection of the density of the toner image;

a process of determining whether there is a missing tone component in the input image data; and a process of complementing the input-output characteristics data corresponding to the missing tone component, when it is determined that there is the missing tone component.

18. An image forming apparatus comprising:

an image forming section configured to form a first output image in accordance with first image data;

a density detecting section configured to detect a density of the first output image formed by the image forming section; and a hardware processor performs density correction in accordance with a result of detection performed by the density detecting section, wherein the hardware processor calculates a result of detection in a second output image in accordance with the result of the detection in the first output image by the density detecting section, and performs the density correction using a result of calculation, the result of the detection in the second output image being performed by the density detecting section on the assumption that the second output image is formed by the image forming section in accordance with second image data including color information not included in the first image data.

19. The image forming apparatus according to claim 18, wherein, in accordance with a result of detection in a multicolor image in the first output image and a result of detection in a monochrome image forming the multicolor image, the hardware processor calculates a result of detection in another monochrome image in the multicolor image.

20. The image forming apparatus according to claim 19, wherein, when the monochrome image forming the multicolor image has a tone between a tone 80% and a tone 100%, the hardware processor corrects chromatic coordinates representing the multicolor image, and calculates a result of detection in the second output image in accordance with the corrected chromatic coordinates.

21. The image forming apparatus according to claim 18, wherein, in accordance with a result of detection in a monochrome image forming a multicolor image in the first output image, the hardware processor calculates a result of detection in the multicolor image.

22. The image forming apparatus according to claim 18, wherein the hardware processor performs the density correction, with a result of detection being the result of the calculation, the result of the calculation being calculated in advance.

23. The image forming apparatus according to claim 18, wherein the hardware processor determines color information about the second image data, in accordance with an object to be subjected to the density correction.

24. The image forming apparatus according to claim 18, wherein the density detecting section detects the density of the first output image output onto the image bearing member.

25. The image forming apparatus according to claim 24, wherein the image bearing member is a transfer belt.

26. The image forming apparatus according to claim 18, wherein the color information includes tone data indicating the density, and the density correction is correction of the tone data.

27. The image forming apparatus according to claim 26, wherein the hardware processor performs density correction on a multicolor image obtained by combining a plurality of monochrome images of the same tone.

28. The image forming apparatus according to claim 27, wherein the hardware processor corrects tone data of the multicolor image in performing the density correction on the multicolor image.

29. The image forming apparatus according to claim 26, wherein the tone data to be corrected has a tone between a tone 80% and a tone 100%.

30. The image forming apparatus according to claim 26, wherein the tone data to be corrected has a tone between a tone 45% and a tone 55%.

31. The image forming apparatus according to claim 18, wherein the density correction is correction of a printing condition for forming the first output image.

32. The image forming apparatus according to claim 18, wherein, in accordance with results of detection detected from a predetermined number of the first output images, the hardware processor calculates a result of detection in the second output image.

33. The image forming apparatus according to claim 18, wherein the hardware processor performs the density correction in accordance with a reliability of a result of detection in the second output image.

34. An image forming system comprising a plurality of units including the image forming apparatus according to claim 18.

35. An image density correction method comprising:

forming a first output image in accordance with first image data;

detecting a density of the formed first output image;

performing density correction in accordance with a result of the detection when the first image data includes color information, and when the first image data does not include color information, calculating a result of detection in a second output image in accordance with the result of detection in the first output image, on the assumption that the second output image is formed in accordance with second image data including the color information not included in the first image data, and performing the density correction using a result of calculation.

* * * * *